US010551136B2

(12) United States Patent
Carimati Di Carimate

(10) Patent No.: US 10,551,136 B2
(45) Date of Patent: Feb. 4, 2020

(54) SEMI-AUTOMATIC RIFLE RESTRICTORS

(71) Applicant: Ascanio L. Carimati Di Carimate, Los Angeles, CA (US)

(72) Inventor: Ascanio L. Carimati Di Carimate, Los Angeles, CA (US)

( * ) Notice: Subject to any disclaimer, the term of this patent is extended or adjusted under 35 U.S.C. 154(b) by 23 days.

(21) Appl. No.: 15/932,518

(22) Filed: Mar. 12, 2018

(65) Prior Publication Data

US 2019/0277587 A1 Sep. 12, 2019

(51) Int. Cl.
*F41A 3/20* (2006.01)
*F41A 5/24* (2006.01)

(52) U.S. Cl.
CPC . *F41A 3/20* (2013.01); *F41A 5/24* (2013.01)

(58) Field of Classification Search
CPC ..... F41A 3/20; F41A 5/24; F41A 9/52; F41A 3/66; F41A 5/26; F41A 15/14; F41A 3/72
USPC ..... 89/128
See application file for complete search history.

(56) References Cited

U.S. PATENT DOCUMENTS 9,279,628 B1 * 3/2016 Pollack ..... F41A 3/12
9,470,469 B2 10/2016 Daniel et al.
9,638,481 B1 * 5/2017 Marano ..... F41A 3/02
2003/0066226 A1 * 4/2003 Martin ..... F41A 3/72
42/16
2010/0319528 A1 * 12/2010 Kenney ..... F41A 5/26
89/193
2011/0061523 A1 * 3/2011 Webb ..... F41A 3/42
89/128
2011/0094373 A1 * 4/2011 Cassels ..... F41A 5/26
89/191.01
2014/0060311 A1 * 3/2014 Christenson ..... F41A 5/18
89/191.01
2014/0311004 A1 * 10/2014 Barrett ..... F41A 17/42
42/16
2016/0178308 A1 * 6/2016 Daniel ..... F41A 35/00
89/193
2018/0142975 A1 * 5/2018 Hoon ..... F41A 9/52

* cited by examiner

*Primary Examiner* — Joshua E Freeman
*Assistant Examiner* — Bridget A Cochran

(57) ABSTRACT

A production direct gas impingement semi-automatic AR-style rifle is converted to a single shot, straight pull bolt action rifle that includes: a) conventional rifle components, including an upper receiver and lower, trigger, trigger guard, barrel; b) a direct gas impingement semi-automatic firing mechanism including automatic gas actuated casing ejection, automatic gas actuated bolt and hammer reset, and automatic gas actuated cartridge reload functionality, including a bolt carrier with two production carrier gas key screw threaded receiving orifices and having no production carrier gas key, and a having a metal gas blocking and diverting mechanism attached to the bolt carrier in the place of a production carrier gas key. This inhibits semi-automatic operation of the rifle by disabling the automatic gas actuated casing ejection, bolt and hammer reset, and cartridge reload functionality. In some embodiments the bolt carrier assembly and aforementioned gas diverting block mechanism components are unistructurally formed.

10 Claims, 21 Drawing Sheets

SEMI-AUTOMATIC RIFLE RESTRICTORS

REFERENCE TO RELATED APPLICATIONS

The present application is a continuation-in-part application based on co-pending U.S. patent application Ser. No. 15/530,856, filed on 10 Mar. 2017, having a common inventor with the inventor herein and titled "SEMI-AUTOMATIC RIFLE RESTRICTOR MECHANISM".

BACKGROUND OF INVENTION a. Field of Invention

The present invention generally relates to the problem of AR-style semiautomatic rifles currently in production and being sold for civilian use, which are now outlawed in a number of states and counties. Tremendous efforts have been made to provide aftermarket devices and conversion kits to render these rifles compliant under recently enacted laws. Such conversions involve one of three approaches: (1) replace all or most of the upper receiver mechanisms of the rifle with parts that have been heavily modified that render the AR style rifle into non-semiautomatic (e.g., bolt-action, break, or pump action) rifle. These options cost many hundreds of dollars (or more); (2) remove vital parts of the firearms action by having professional gunsmiths machine out or modify these parts to render the firearm non-semiautomatic; or (3) a combination of the two proceeding methods. What is lacking in all of these conversion options is an inexpensive and efficient conversion that would require no machining or cutting, but only the substitution of a single part within the firearm. It is this breakthrough to which the present invention is directed. By removing the bolt carrier gas key and replacing it with a fixed, screwed-on gas redirecting block, or alternatively replacing it with a unistructurally formed combined bolt carrier and gas redirecting block, the invention disables the direct gas impingement cycling system of the firearm that automatically ejects the fired casing and resets the bolt of the firearm, automatically reloading another cartridge (i.e., semi-automatic cycling of the firearm's action). Thus, with this simple, fixed conversion, the rifles "direct gas impingement" semiautomatic bolt system is fully disabled, requiring the operator of the firearm to manually eject the fired casing by pulling the handle of the invention straight back and manually load the next cartridge into the firearm's chamber by releasing the invention or affirmatively pushing the invention forward. Thus, this conversion system renders any semiautomatic AR-style rifle with a direct gas impingement cycling system into a "straight-pull bolt-action rifle." By converting these firearms into "straight pull bolt action rifles," the invention removes the firearms from all current laws and regulations that would otherwise ban these firearms (if they were to remain semiautomatic).

b. Description of Related Art

The following patents are representative of the field pertaining to the present invention:

U.S. Pat. No. 9,470,469 B2 to Daniel et al describes an assembly for preventing gas leaks in a bolt carrier group of a firearm is disclosed. The assembly may include a bolt carrier with a gas hole, a bolt carrier gas key attachable to the bolt carrier about the gas hole, a groove disposed on the bolt carrier about the gas hole, and a seal disposed within the groove.

U.S. Pat. No. 9,279,628 B1 to Pollack relates to kits and associated methods for converting a semi-automatic firearm into a bolt single action firearm, as well as the converted firearm itself. The kit includes a housing (e.g. upper receiver) that accommodates a bolt carrier and a charging handle and a carrier key, if desired. The housing has ends which mount to the existing lower receiver of the semi-automatic firearm to convert the semi-automatic firearm into a manual bolt-action firearm.

United States Patent Application Publication No. US 2016/0178308 A1 to Daniel et al. describes an assembly for preventing gas leaks in a bolt carrier group of a firearm is disclosed. The assembly may include a bolt carrier with a gas hole, a bolt carrier gas key attachable to the bolt carrier about the gas hole, a groove disposed on the bolt carrier about the gas hole, and a seal disposed within the groove.

United States Patent Application Publication No. US 2014/0311004 A1 to Barrett describes a bolt control device for causing the bolt of a firearm to be held in a retained open position after each round is fired, the bolt control device capable of being manipulated by the user to also release and return the bolt to a firing position so that the firearm may be used to fire an additional round.

United States Patent Application Publication No. US 2014/0060311 A1 to Christenson describes an improved gas key assembly for a fire arm, such as an AR 15 or a M4 rifle, having a gas key fastened by fasteners on a bolt carrier assembly where the gas key moves with the bolt carrier when the fire arm is fired, wherein the gas key has a slot for receiving a key element in the slot and the key element has a stem which is seated in the slot and a rail which overlays the fasteners to removably secure the gas key to the bolt carrier and holds gas key resisting unintended separation of the gas key from the bolt carrier. Also the invention includes a method for securing a gas key to a bolt carrier in such a fire arm.

United States Patent Application Publication No. US 2011/0094373 A1 to Cassels describes a convertible gas piston conversion system for the AR-15, AR-10, or their variant rifle platforms is provided to convert the platform from a direct impingement gas system to a piston driven operating system. The conversion system includes a gas block having a barrel bore and two piston cylinder bores one on either side of the gas block. One of the piston cylinder bores is for utilization of the AR-15 rifle and the other of the piston cylinder bores is for utilization of the AR-10 rifle, making this piston system convertible for the AR-15, AR-10, or any of their variant rifle platforms. A piston cylinder is inserted into the gas block via the piston cylinder bore and a piston is actuated inside the piston cylinder to cycle the rifle. A connecting link is coupled between the piston and an op-rod making the gas systems length adjustable by simply replacing the connecting link. The op-rod acts directly upon a carrier lug to cycle the rifle and a compression spring or the like returns the piston back into the battery within the piston cylinder. An op-rod bushing guides the op-rod throughout travel. A bolt carrier includes a lug and an anti-tilt/anti wear device. The bolt carrier provides a lug for the op-rod to impinge upon to cycle the rifle. The anti-tilt/anti wear bolt carrier device installs into the rear of the bolt carrier to minimize damage and wear to the buffer tube and upper receiver from a condition identified as carrier tilt.

United States Patent Application Publication No. US 2010/0319528 A1 to Kenney et al describes a gas plug retention and removal device for a gas operating system of a firearm. The gas operating system can include a gas block comprising a front end, a rear end, a gas block bore defined between the front and rear ends, and at least one cam engagement surface. A gas plug can be removably received in the front end of the gas block for at least partially sealing the gas block bore, and a cam lever bail can be pivotally coupled to the gas plug and include at least one lever arm. The at least one lever arm can be pivotally connected to the gas plug, be adapted to engage the gas block, and have at least one cam lobe formed therealong. The at least one cam lobe can engage the cam engagement surface of the gas block as the cam lever bail is pivoted so as to disengage and facilitate the removal of the gas plug from the gas block to provide access to the gas block bore.

Notwithstanding the prior art, the present invention is neither taught nor rendered obvious thereby.

SUMMARY OF INVENTION

The present invention is directed to methods and devices that relate to AR-style rifle conversions in order to render them non-semiautomatic rifles under current definitions of California and other state laws. The present invention is a substituted part, a gas diverting block, that replaces the gas key of an AR-style semiautomatic rifle by the invention's installation onto the bolt carrier of the firearm, or a substituted part that is a unistructurally combined bolt carrier and gas diverting block, while, in some embodiments, simultaneously acting as the firearm's "charging handle." This substitution prohibits the firearm from automatically ejecting a fired casing and automatically loading the next cartridge into the firearm chamber by blocking the direct gas impingement cycling system of the firearm. By prohibiting the direct gas impingement cycling system of the AR-style rifle, the installation of the present invention successfully converts the semiautomatic rifle into a single shot, straight pull bolt action rifle.

Thus, the present invention is directed to methods and devices that relate to AR style rifle conversions to render them non-semiautomatic. In some preferred embodiments, the production AR style semi-automatic rifle that has been fixedly converted to a single shot, straight pull bolt action rifle, includes: a) conventional AR-style rifle components, including but not limited to an upper receiver and lower, trigger, trigger guard, barrel; b) a semi-automatic firing mechanism including a gas actuated casing ejection and gas actuated bolt and hammer reset and cartridge reload mechanism and including a bolt carrier with two threaded carrier gas key screw receiving orifices and having no production carrier gas key and a having a fixed dual-bored metal gas diverting block mechanism attached to said bolt carrier at said two threaded carrier key screw receiving orifices, said dual-bored metal gas diverting block mechanism having a front end that is at least partially askew from a right angle to said bolt carrier, said front end being selected from the group consisting of: (i) a front end having a front wall with a deflection wall angled askew from said right angle to said bolt carrier; and (ii) a front end having a deflection channel angled askew from said right angle to said bolt carrier; said dual-bored metal gas diverting block mechanism being positioned so as to inhibit semi-automatic operation of said semi-automatic rifle by disabling the automatic gas actuated casing ejection, the automatic gas actuated bolt and hammer reset, and the automatic gas actuated cartridge reload functionality, thereby rendering it a single shot, straight pull bolt action rifle.

In other preferred embodiments, the production AR style semi-automatic rifle that has been fixedly converted to a single shot, straight pull bolt action rifle, includes: a) conventional AR-style rifle components, including but not limited to an upper receiver and lower, trigger, trigger guard, barrel; b) a semi-automatic firing mechanism including automatic gas actuated casing ejection, automatic gas actuated bolt and hammer reset, and automatic gas actuated cartridge reload functionality and including a bolt carrier component that is unistructurally formed, and includes a bolt carrier structure and an integrated metal gas diverting block mechanism, said metal gas diverting block mechanism having a front end that is selected from the group consisting of: (i) said front end being at least partially flat at a right angle to said bolt carrier; (ii) said front end having a deflection wall angled askew from said right angle to said bolt carrier; and (ii) said front end having a deflection channel angled askew from said right angle to said bolt carrier; said metal gas diverting block mechanism being positioned so as to inhibit semi-automatic operation of said semi-automatic rifle by disabling the automatic gas actuated casing ejection, automatic gas actuated bolt and hammer reset, and automatic gas actuated cartridge reload functionality, thereby rendering it a single shot, straight pull bolt action rifle.

In some embodiments of the present invention, production semi-automatic rifle that has been converted to a single shot, straight pull bolt action rifle, the metal gas diverting block is a metal selected from the group consisting of an aluminum, titanium, steel and stainless steel.

In some embodiments of the present invention, production semi-automatic rifle that has been converted to a single shot, straight pull bolt action rifle, the bolt carrier has a top flat portion with two threaded orifices for receiving carrier gas key screws and the metal block gas mechanism contains two corresponding orifices and the metal block gas mechanism is screwed to the bolt carrier.

In some embodiments of the present invention, production semi-automatic rifle that has been converted to a single shot, straight pull bolt action rifle, the metal gas diverting block is a unitary component.

In some embodiments of the present invention, production semi-automatic rifle that has been converted to a single shot, straight pull bolt action rifle, the metal gas diverting block is a two-component metal gas diverting block.

In some embodiments of the present invention, production semi-automatic rifle that has been converted to a single shot, straight pull bolt action rifle, includes a charge handle element which further includes at least one backward extending pull handle.

In some embodiments of the present invention, production semi-automatic rifle that has been converted to a single shot, straight pull bolt action rifle, the charge handle further includes two opposing backward extending pull handles.

In some embodiments of the present invention, production semi-automatic rifle that has been converted to a single shot, straight pull bolt action rifle, the charge handle and said two opposing backward extending pull handles are a unitary component.

In some embodiments of the present invention, production semi-automatic rifle that has been converted to a single shot, straight pull bolt action rifle, the charge handle and said two opposing backward extending pull handles are separate components that are connected to one another.

In some embodiments of the present invention, production semi-automatic rifle that has been converted to a single shot, straight pull bolt action rifle, the two opposing backward extending pull handles are left hand and right hand pull handles respectively, and one of said left hand and right hand pull handles further includes a pull handle extension removably attached to it, and further wherein said pull handle extension is interchangeable with the other of one of said left hand and right hand pull handles such that it is attachable to either of said left hand and right hand pull handles.

In some embodiments of the present invention, there is a method of converting a semi-automatic rifle to a single shot, straight pull bolt action rifle which includes: a) removing the bolt carrier with installed carrier gas key from the upper component of said rifle; b) removing said carrier gas key from said bolt carrier; c) installing a dual-bored metal gas diverting block mechanism in place of said carrier gas key on said bolt carrier attached on said bolt carrier at said two threaded carrier gas key screw receiving orifices; and, d) inserting said bolt carrier with said installed metal gas diverting block mechanism back into the upper receiver component of said rifle so as to inhibit semi-automatic operation of said semi-automatic rifle by disabling the automatic gas actuated casing ejection, automatic gas actuated bolt and hammer reset, and automatic gas actuated cartridge reload functionality. In other embodiments, there is another method of converting a semi-automatic rifle to a single shot, straight pull bolt action rifle which includes: a) removing the charge handle and bolt carrier with installed carrier gas key from the upper component of said rifle; b) removing said carrier gas key from said bolt carrier; c) installing a block and a charge/pull handle combination mechanism in place of said carrier gas key on said bolt carrier, that includes a dual-bored and threaded metal gas diverting block mechanism and a charging handle; and, d) inserting bolt carrier with said installed metal gas diverting block mechanism and said charge/pull handle combination mechanism back into the upper receiver component of said rifle.

In some embodiments of the present invention methods above, the metal gas diverting block mechanism is a metal selected from the group consisting of an aluminum, titanium, steel, and stainless steel.

In some embodiments of the present invention methods above, the bolt carrier has a top flat portion with two threaded orifices for receiving carrier gas key screws and said metal gas diverting block mechanism contains two corresponding orifices and said step c) above is performed by screwing said metal gas diverting block mechanism to said bolt carrier.

In some embodiments of the present invention methods above, the metal gas diverting block mechanism is a unitary component.

In some embodiments of the present invention methods above, the metal gas diverting block mechanism is a two-component metal gas diverting block mechanism.

In some embodiments of the present invention methods above, the metal gas diverting block mechanism and charge handle combination is selected from the group consisting of aluminum, titanium, steel and stainless steel.

In some embodiments of the present invention methods above, the bolt carrier has a top flat portion with two threaded orifices for receiving carrier gas key screws and each of said metal gas diverting block mechanism and said charging handle contains two corresponding orifices and said step c) above is performed by screwing said metal gas diverting block mechanism and said charging handle combination to said bolt carrier.

In some embodiments of the present invention methods above, the metal gas diverting block mechanism and charge handle combination is a unitary component.

In some embodiments of the present invention methods above, the metal gas diverting block mechanism and charge handle combination is a two-component metal gas diverting block mechanism.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE SEVERAL VIEWS OF THE DRAWINGS(S)

The accompanying drawings, which are included to provide a further understanding of the invention and are incorporated in and constitute a part of this specification, illustrate preferred embodiments of the invention and together with the detailed description serve to explain the principles of the invention. In the drawings.

Figure 3:
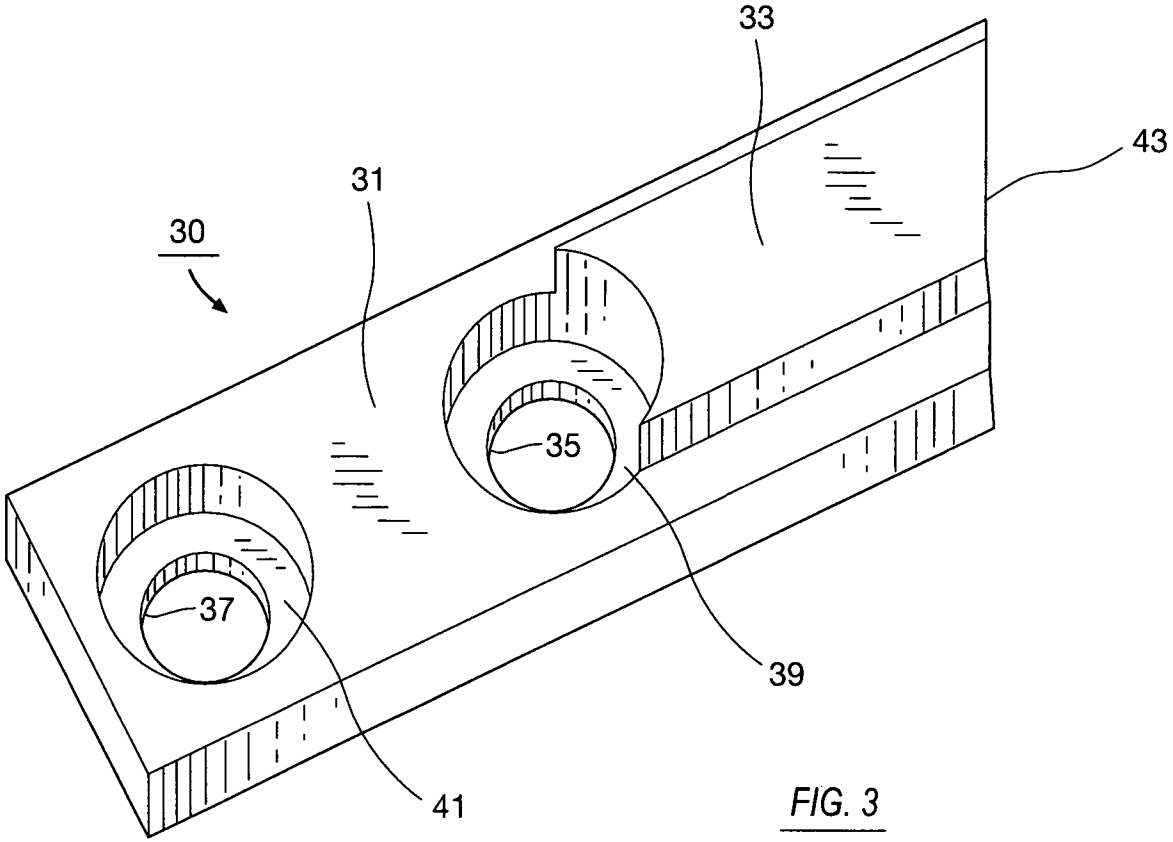
Figure 4A:
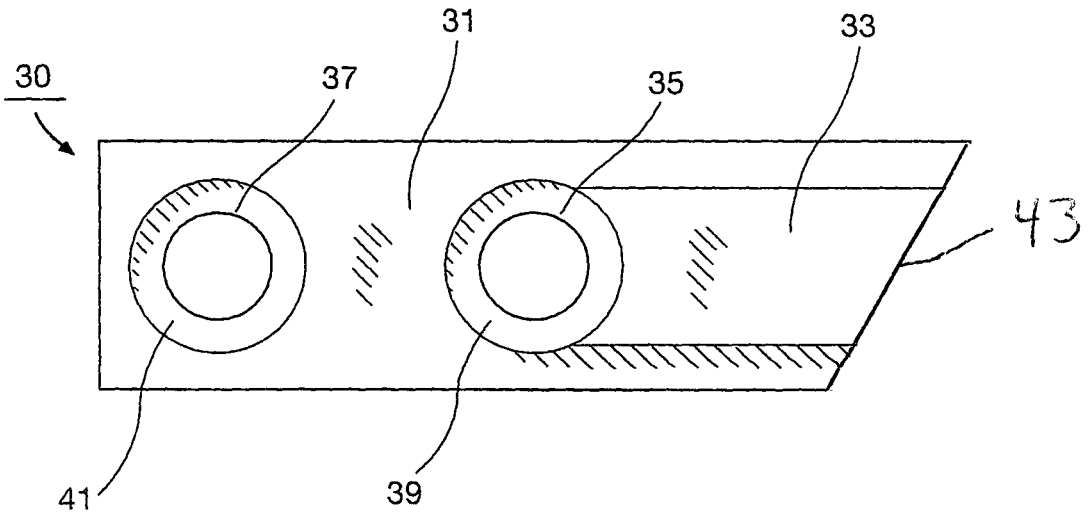
Figure 4B:
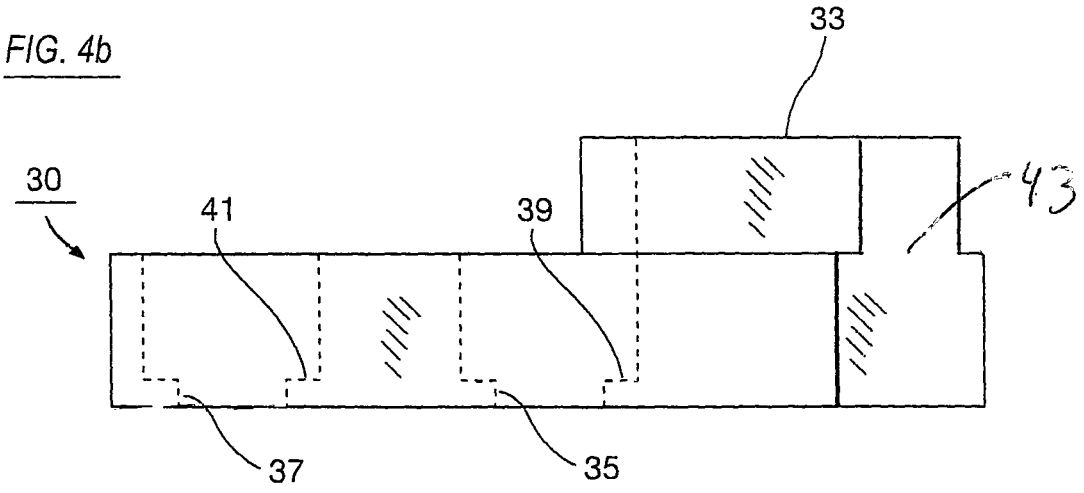
Figure 5:
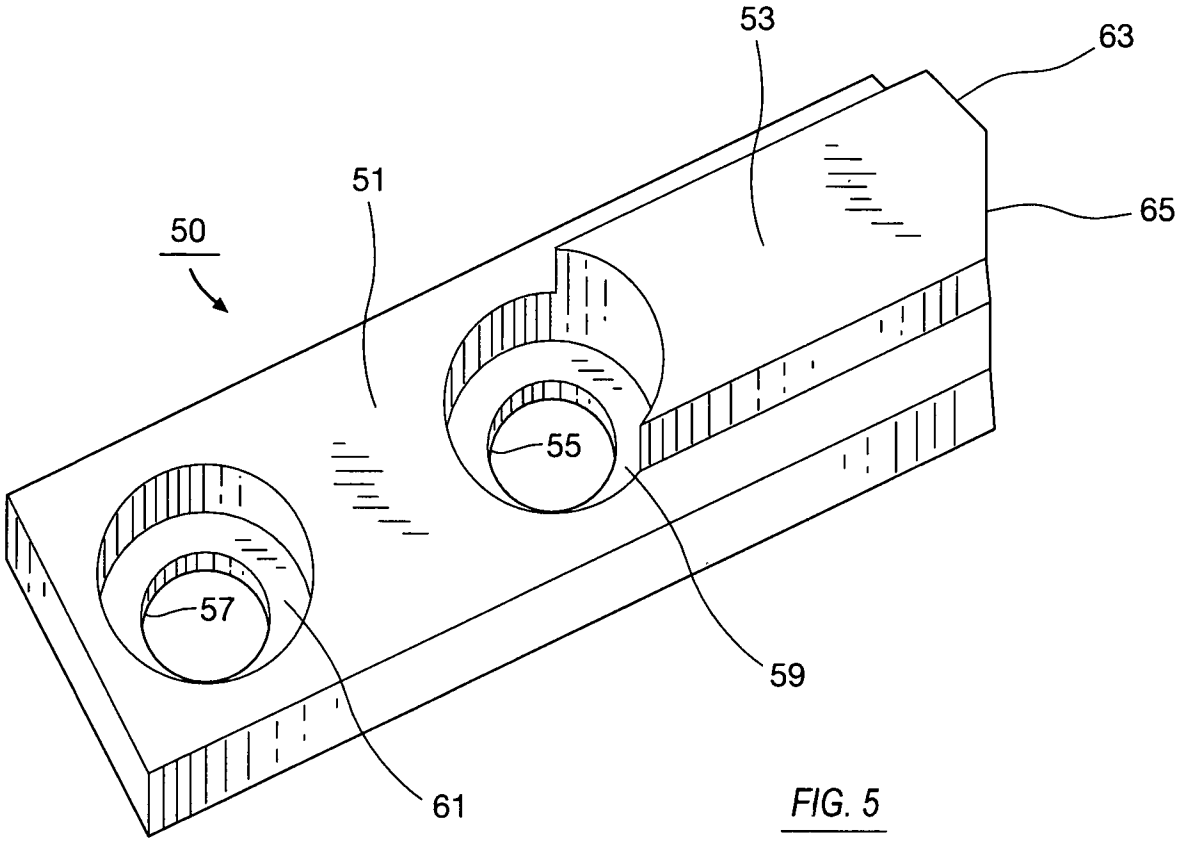
Figure 6A:
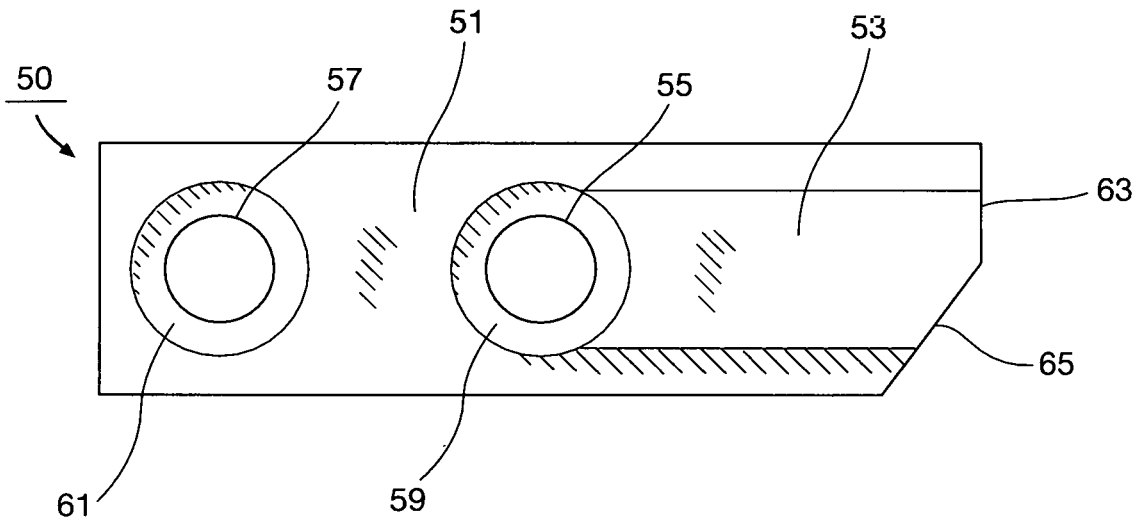
Figure 6B:
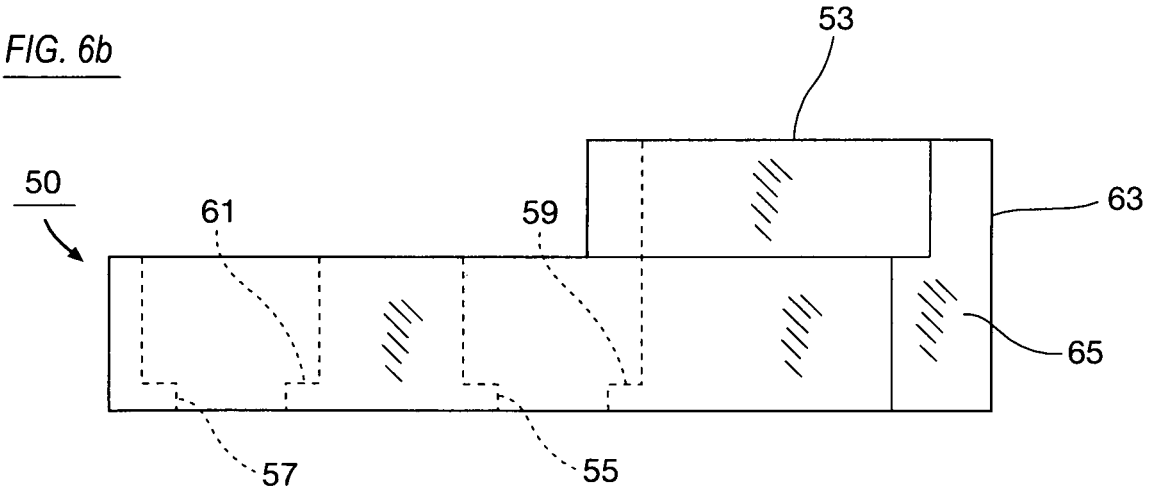
Figure 7:
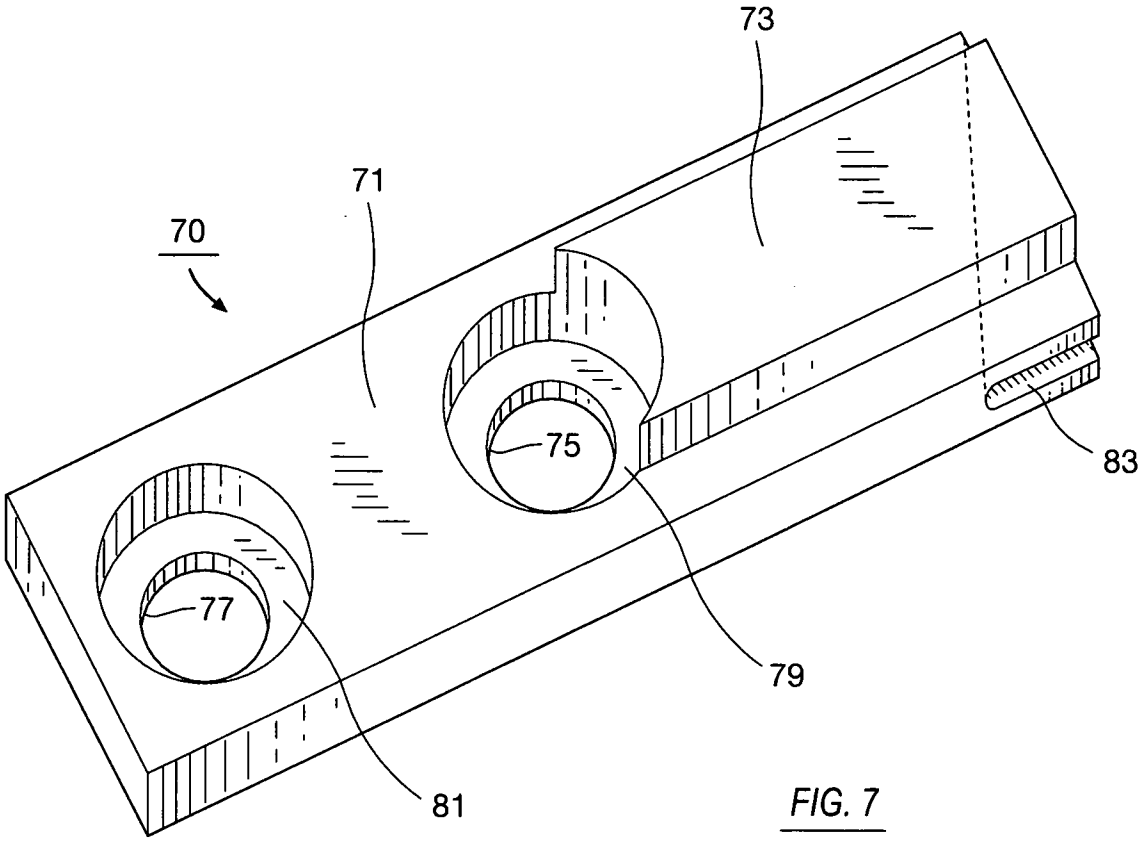
Figure 8A:
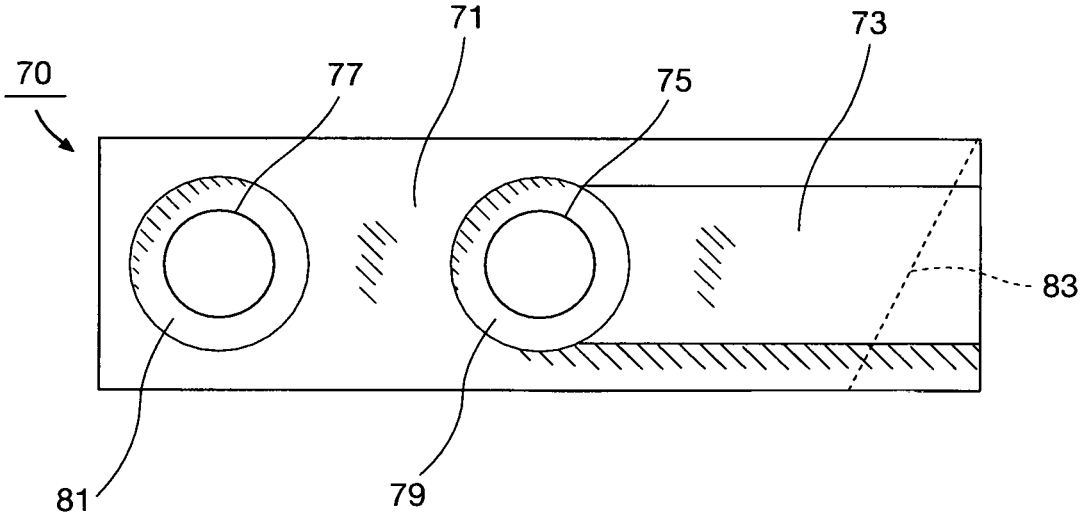
Figure 8B:
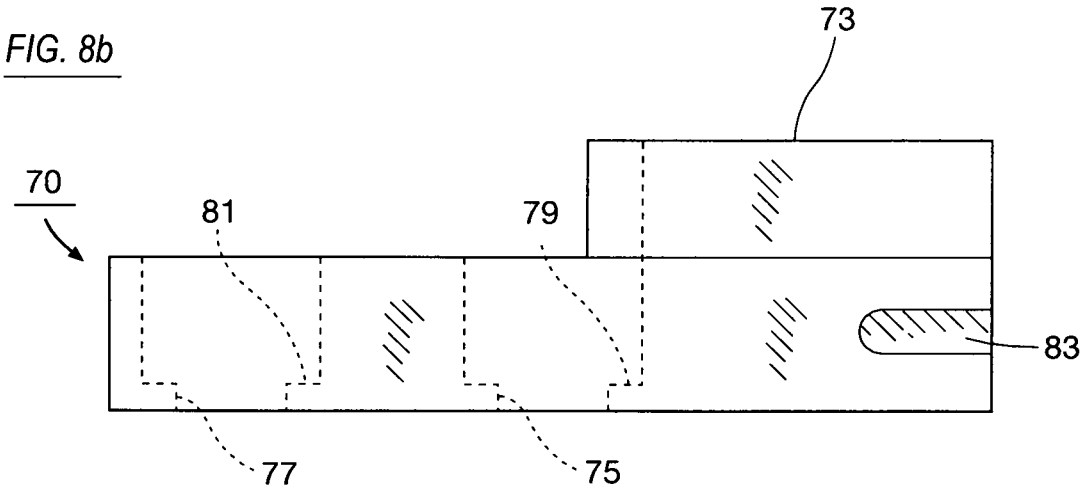
Figure 9:
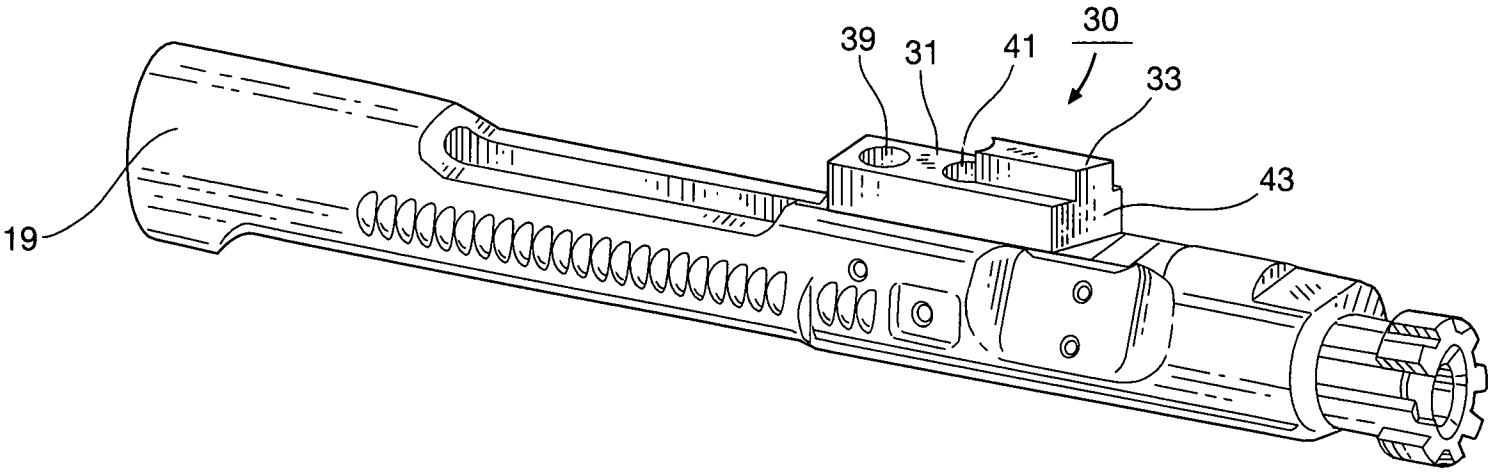

FIG. 3 is an oblique view of one embodiment of the present invention dual-bored metal gas diverting block mechanism having a front end that is at least partially askew from a right angle to the bolt carrier, that replaces the conventional carrier gas key to block gas flow and prevent semi-automatic operation of a rifle, and converts it to a single shot, straight pull bolt action, and FIG. 4*a* shows a top view and FIG. 4*b* shows a side view thereof;

FIG. 5 is an oblique view of one embodiment of the present invention dual-bored metal gas diverting block mechanism having a front end that is at least partially askew from a right angle to the bolt carrier, that replaces the conventional carrier gas key to block gas flow and prevent semi-automatic operation of a rifle and converts it to a single shot, straight pull bolt action, and FIG. 6*a* shows a top view and FIG. 6*b* shows a side view thereof;

FIG. 7 is an oblique view of one present invention dual-bored metal gas diverting block mechanism having a front end that has a channel that is at least partially askew from a right angle to the bolt carrier, that replaces the conventional carrier gas key to block gas flow and prevent semi-automatic operation of a rifle and converts it to a single shot, straight pull bolt action, and FIG. 8*a* shows a top view and FIG. 8*b* shows a side view thereof;

FIG. 9 illustrates an oblique view of a present invention gas diverting metal block mechanism attached to a carrier assembly, utilizing the present invention block of FIGS. 3, 4*a* and 4*b;*

Figure 10:
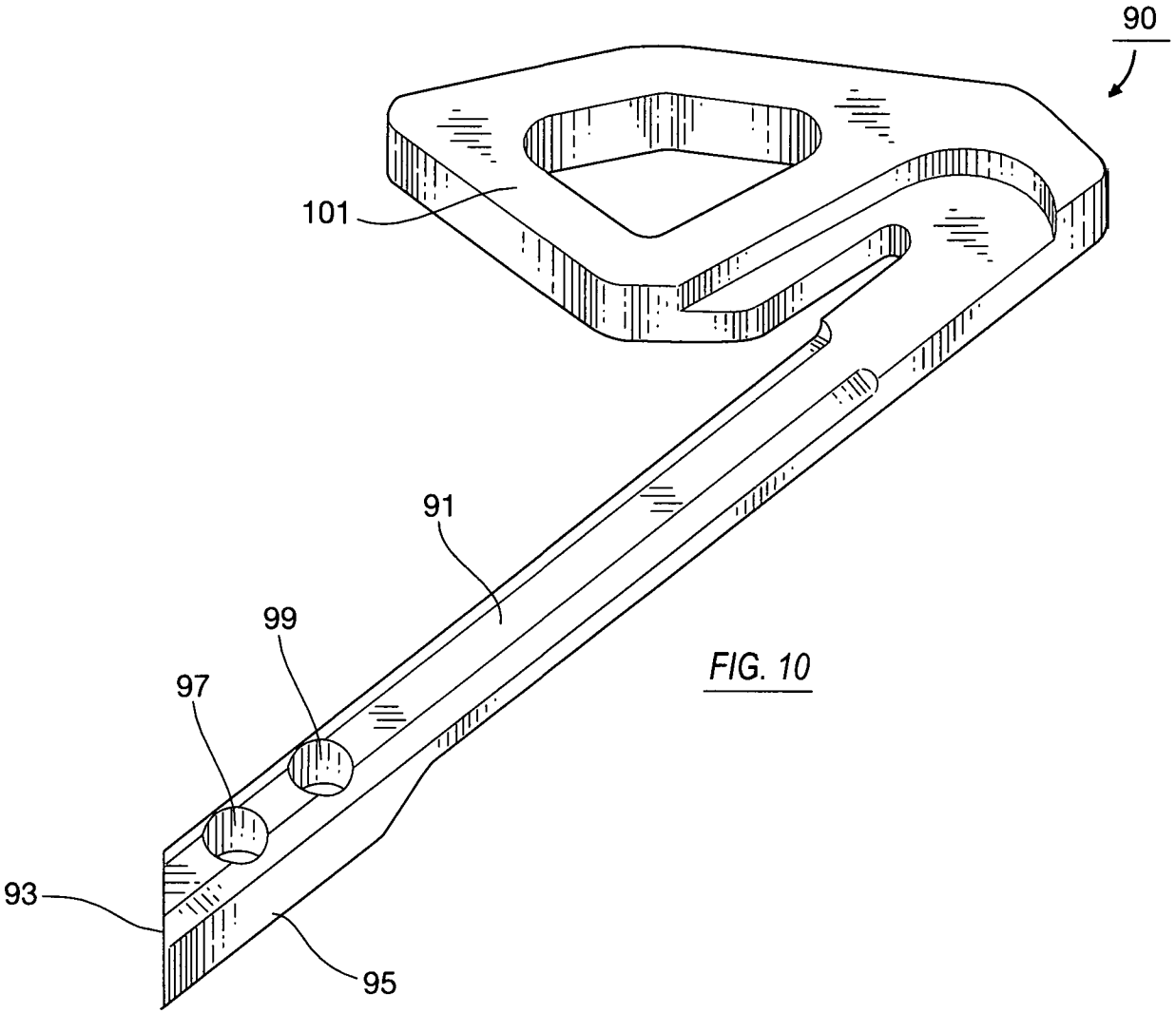
Figure 11:
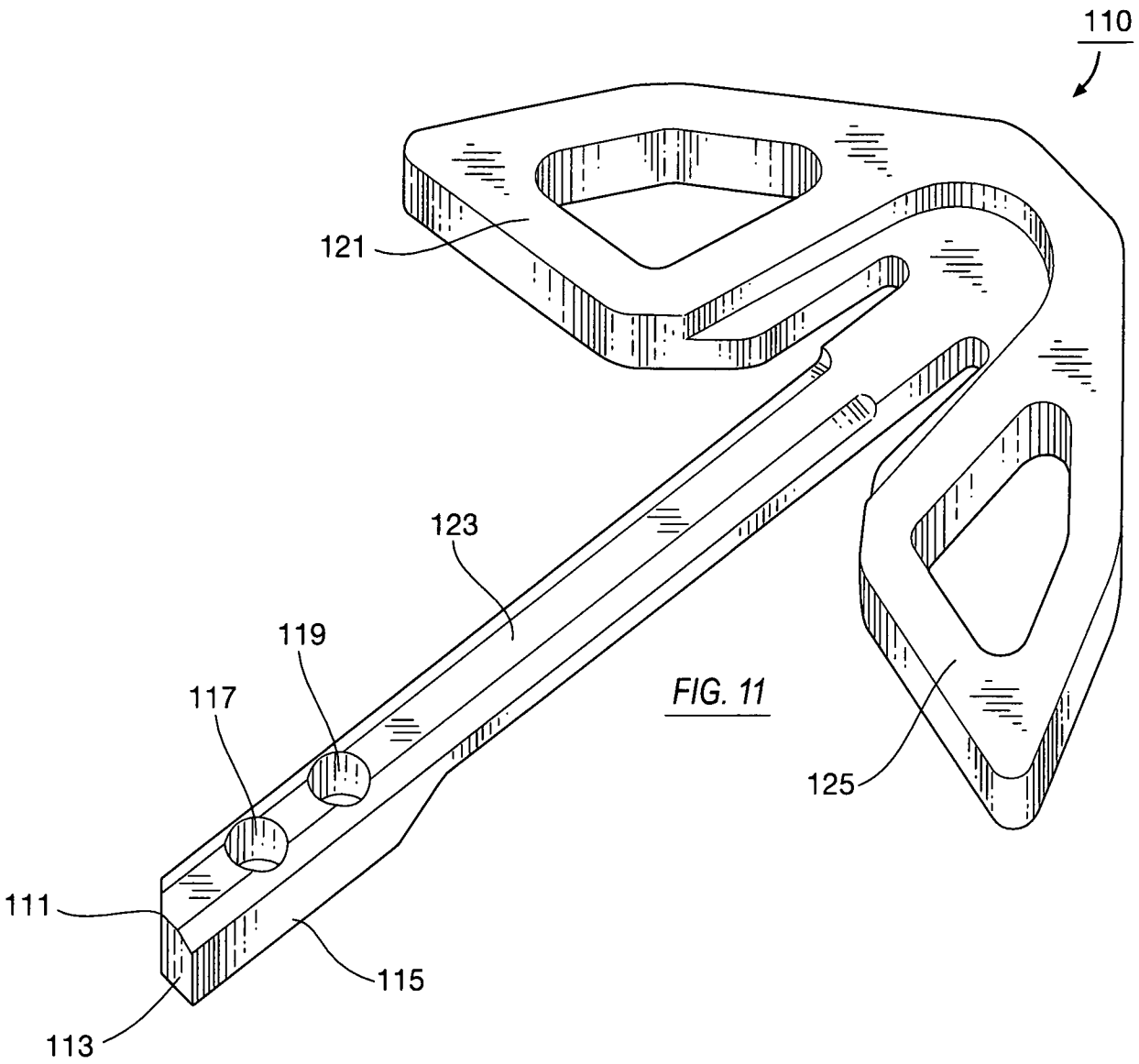
Figure 12:
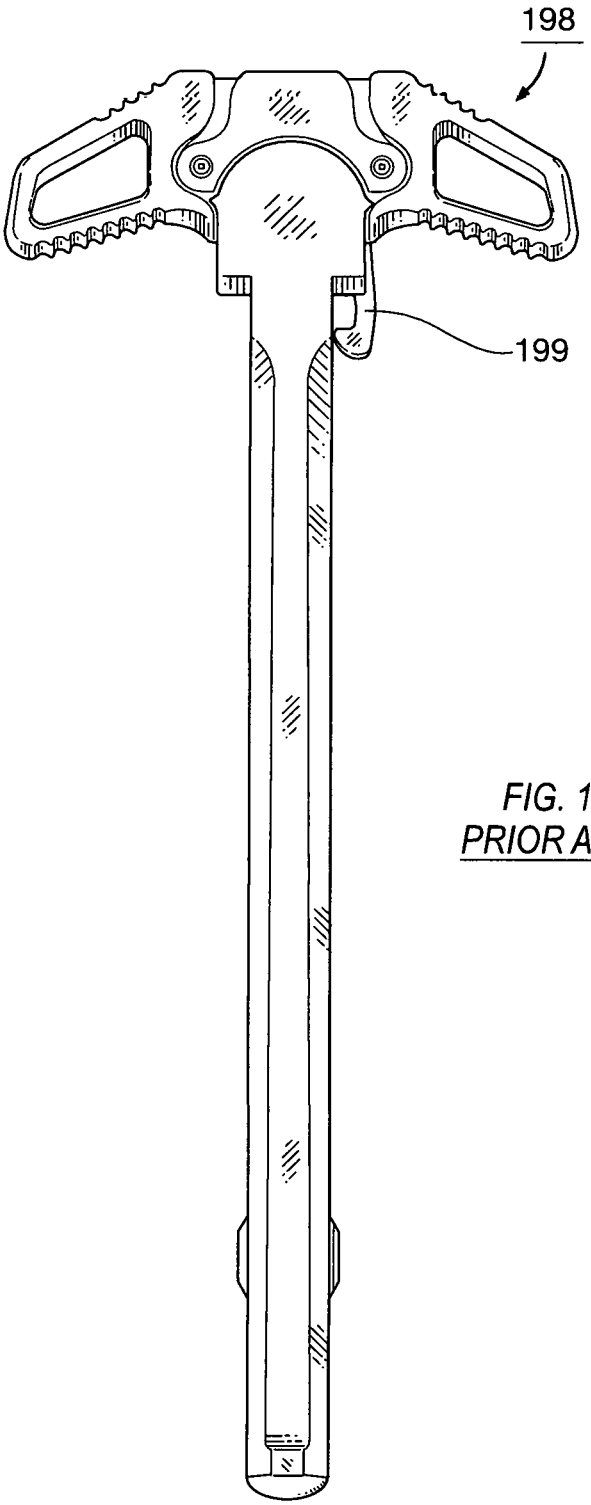
FIG. 12 PRIOR ART
Figure 13:
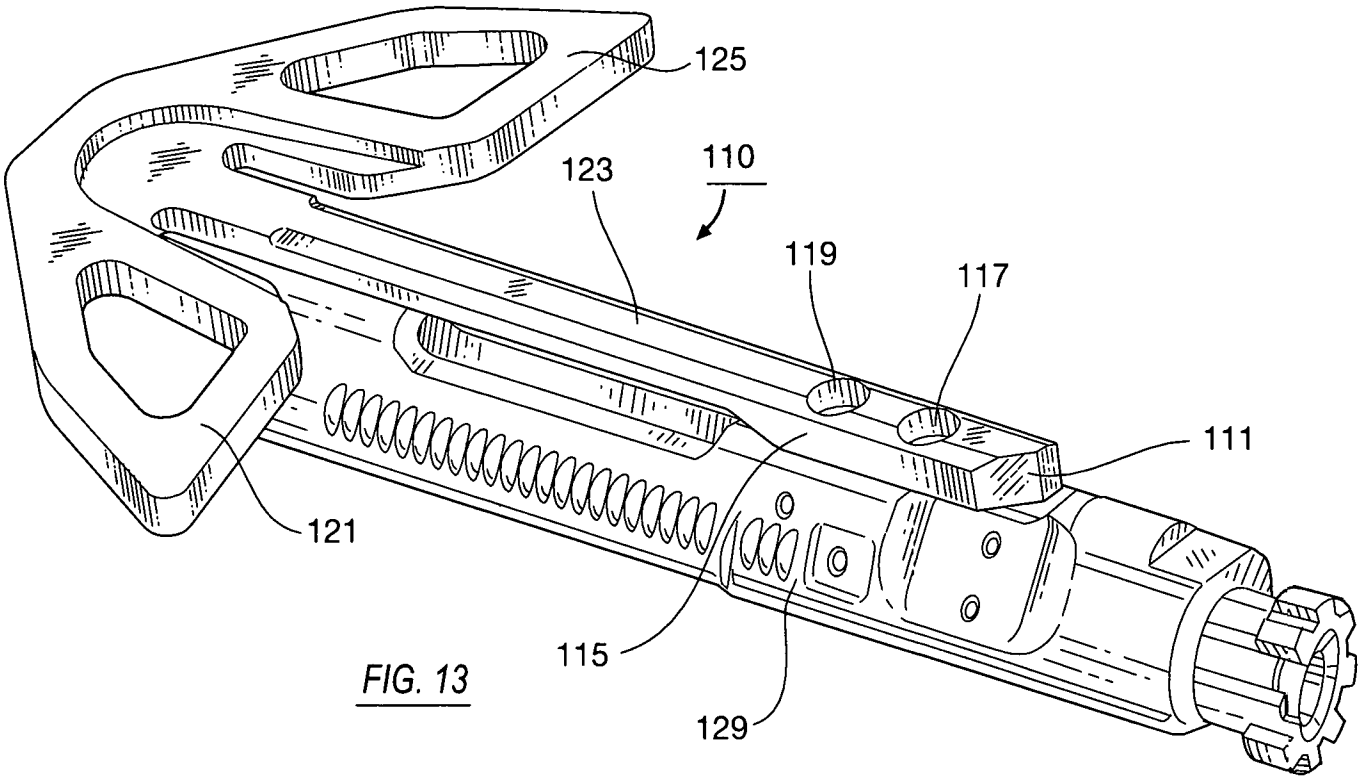
Figure 14B:
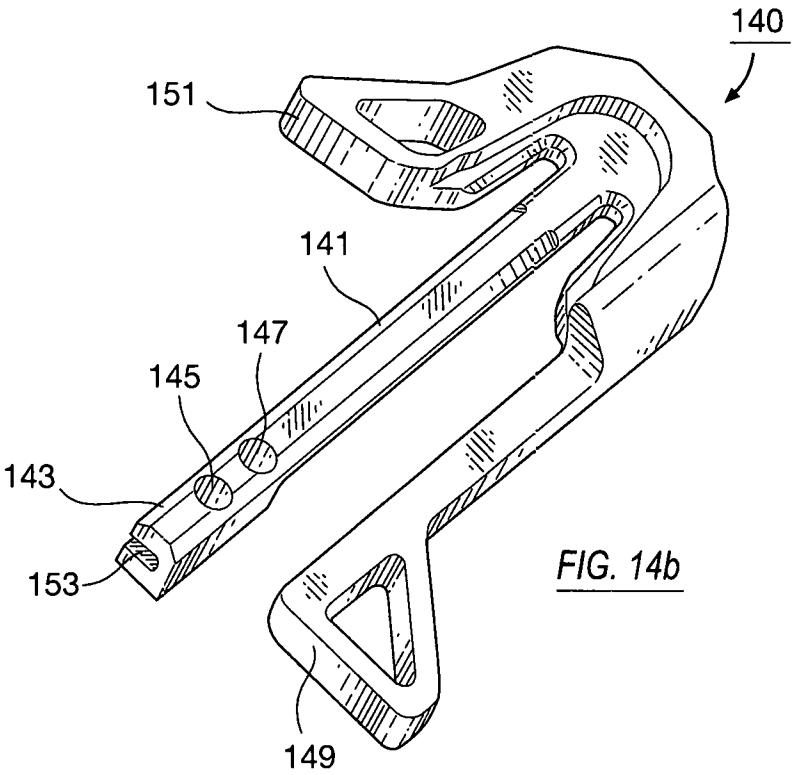
Figure 14A:
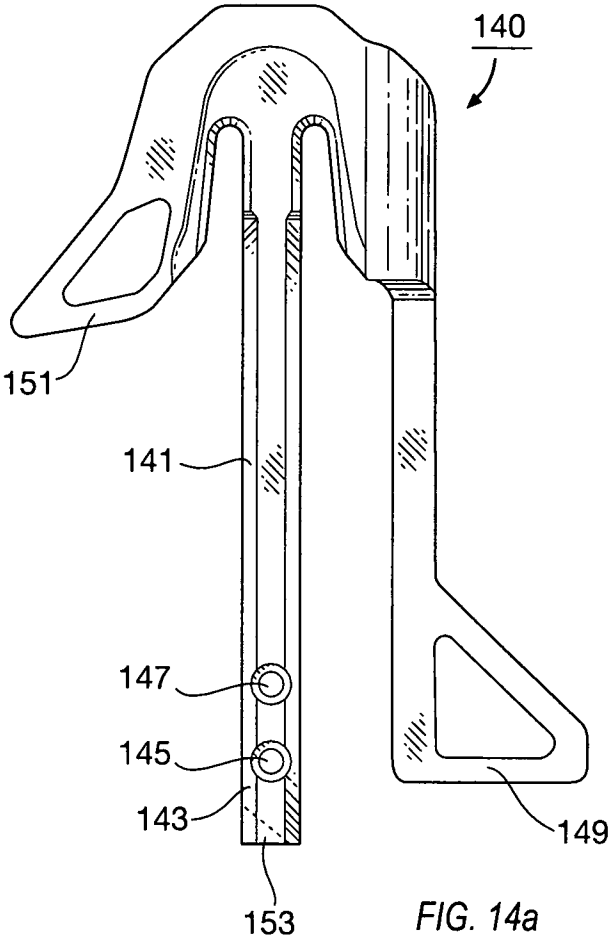
Figure 15B:
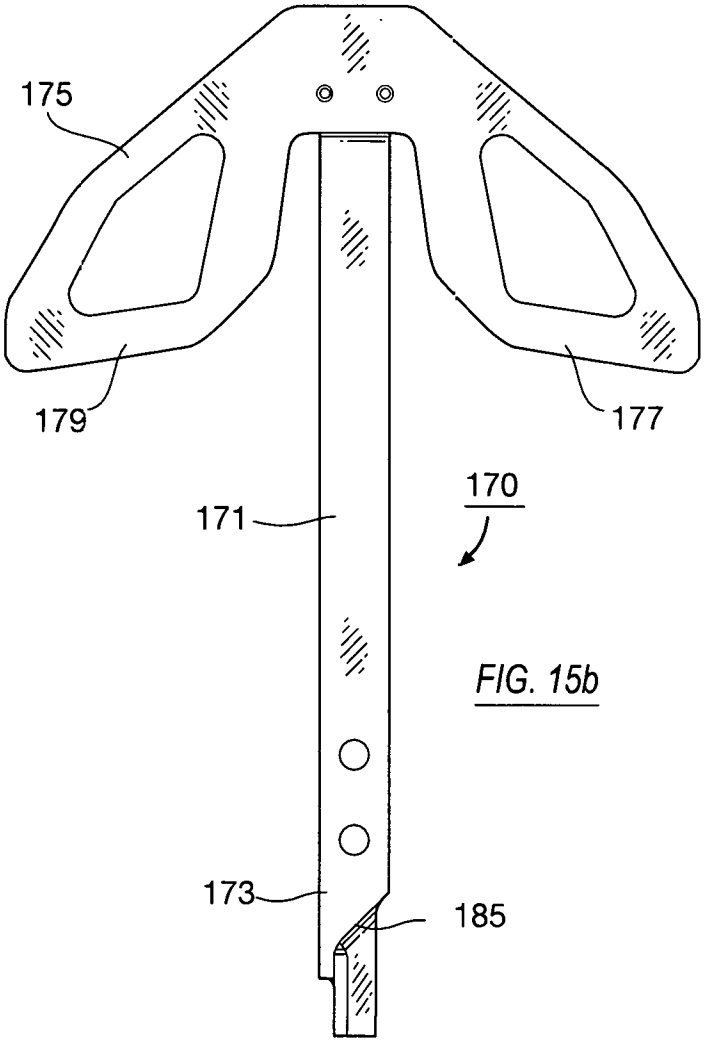
Figure 15A:
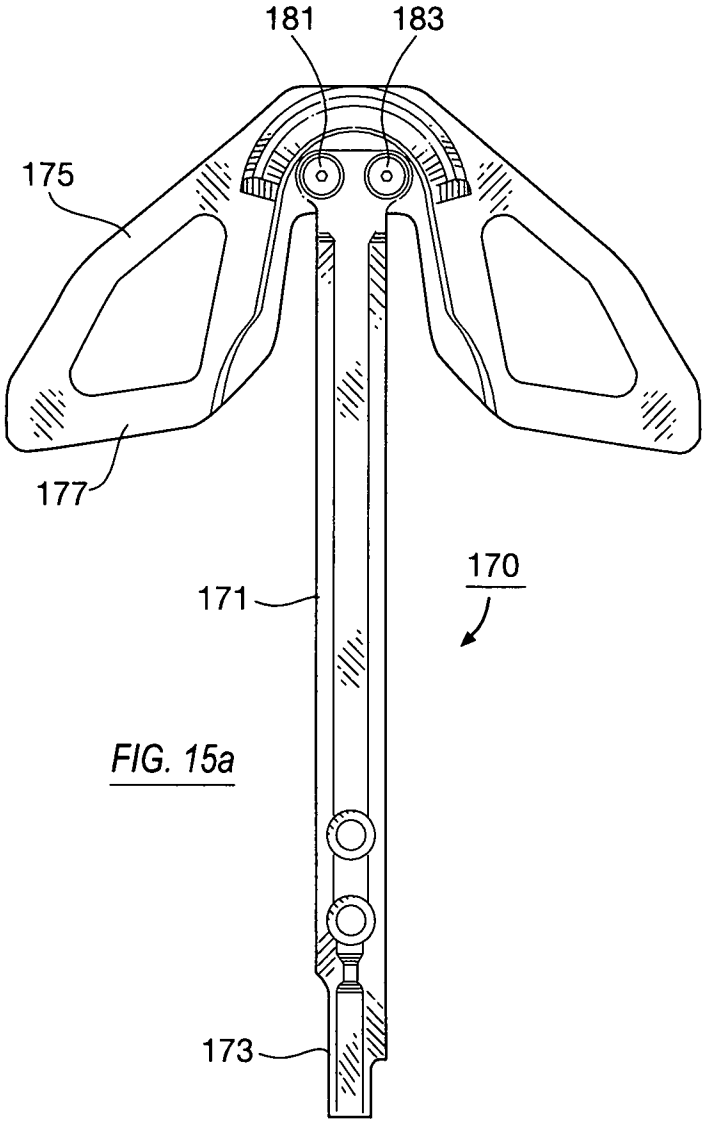
Figure 15C:
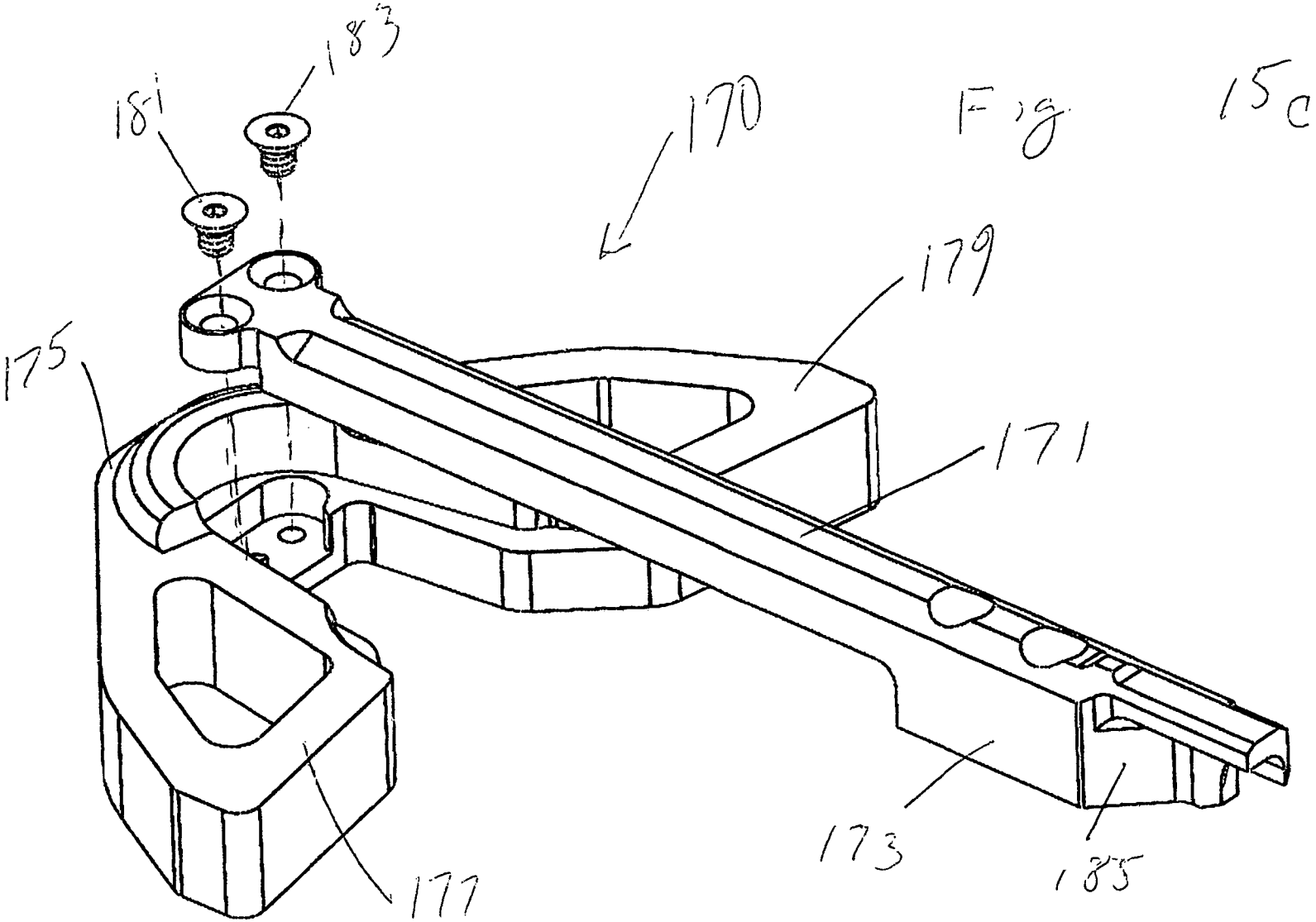
Figure 16:
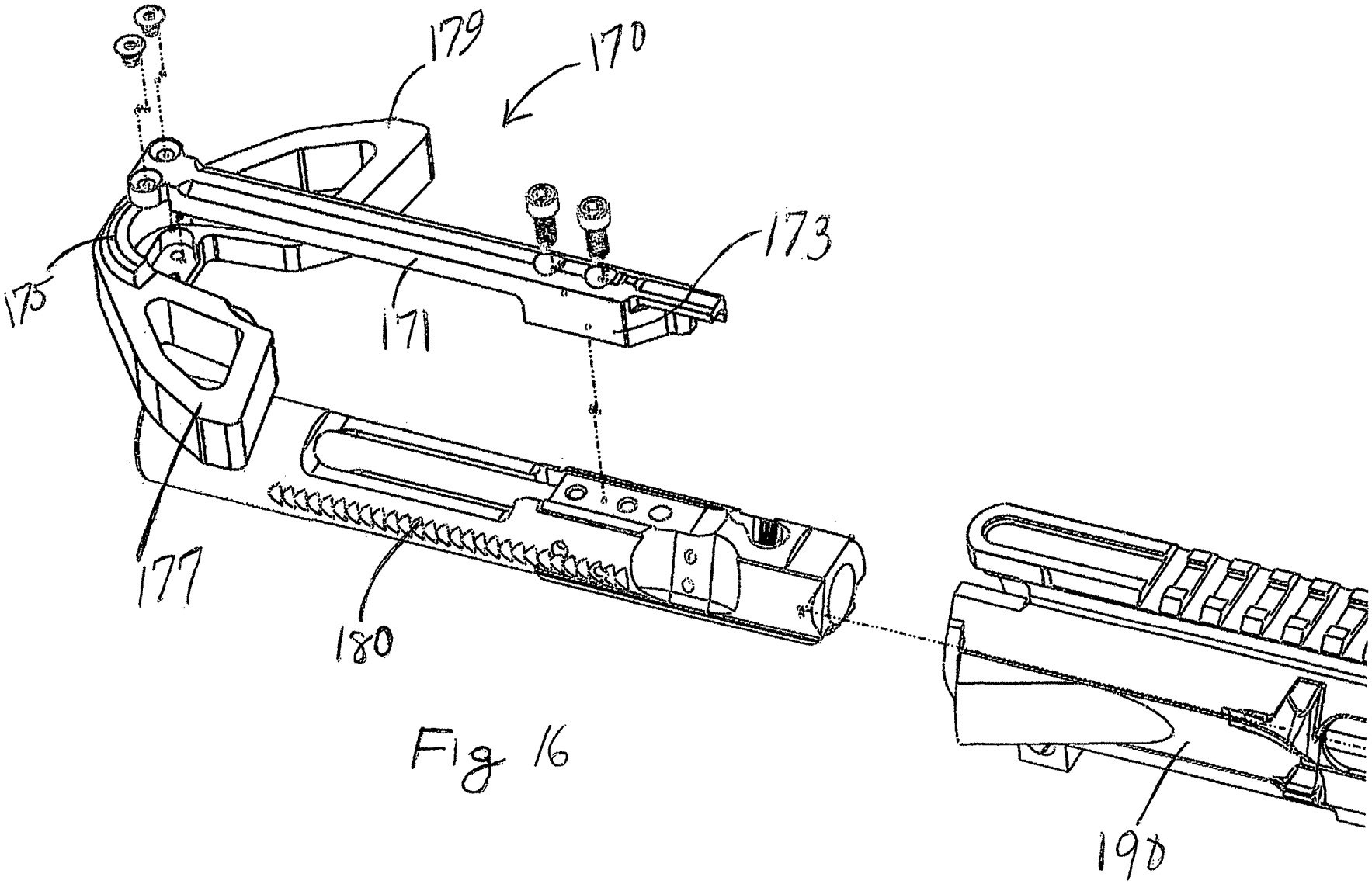
Figure 17A:
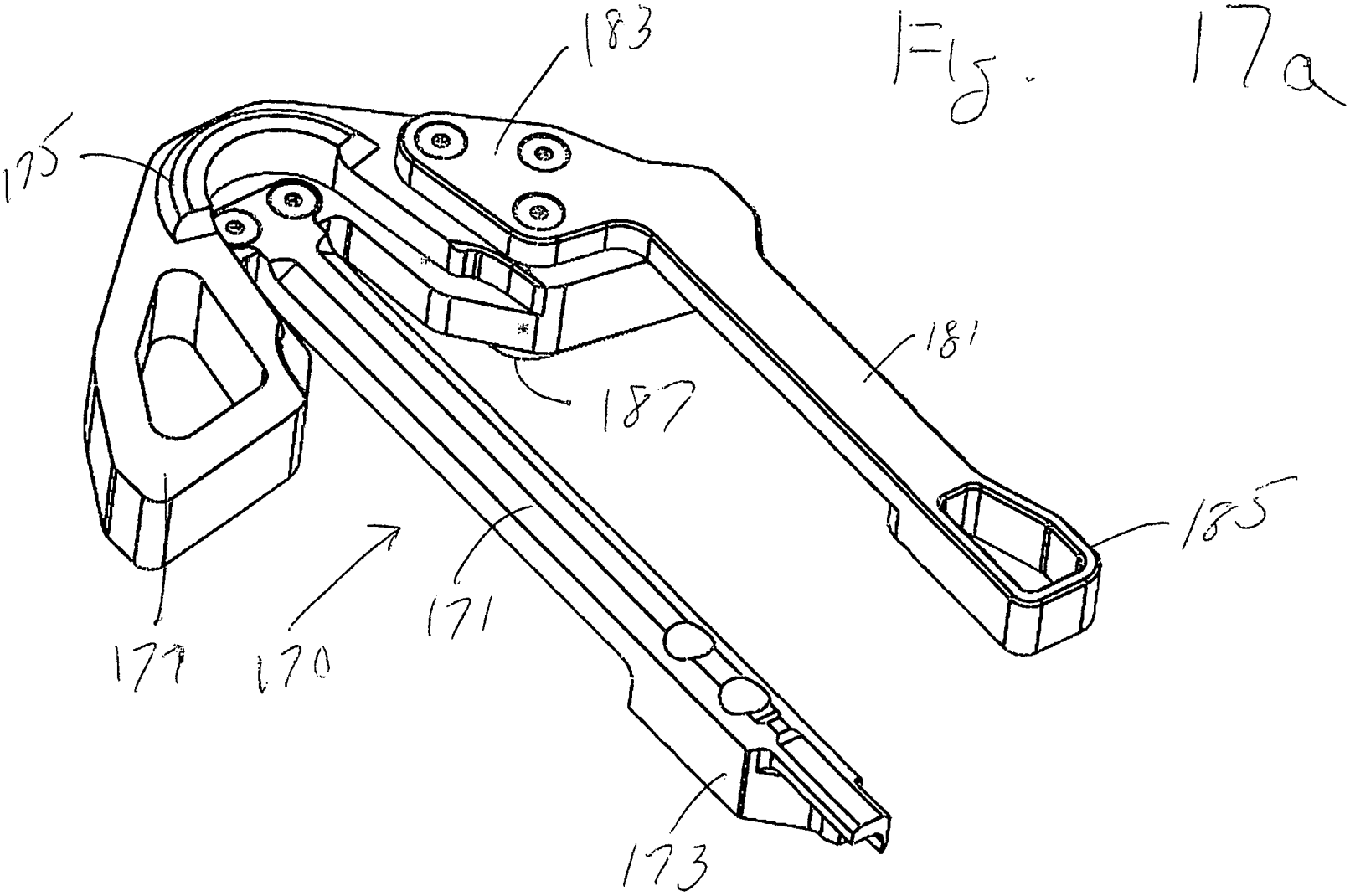
Figure 17B:
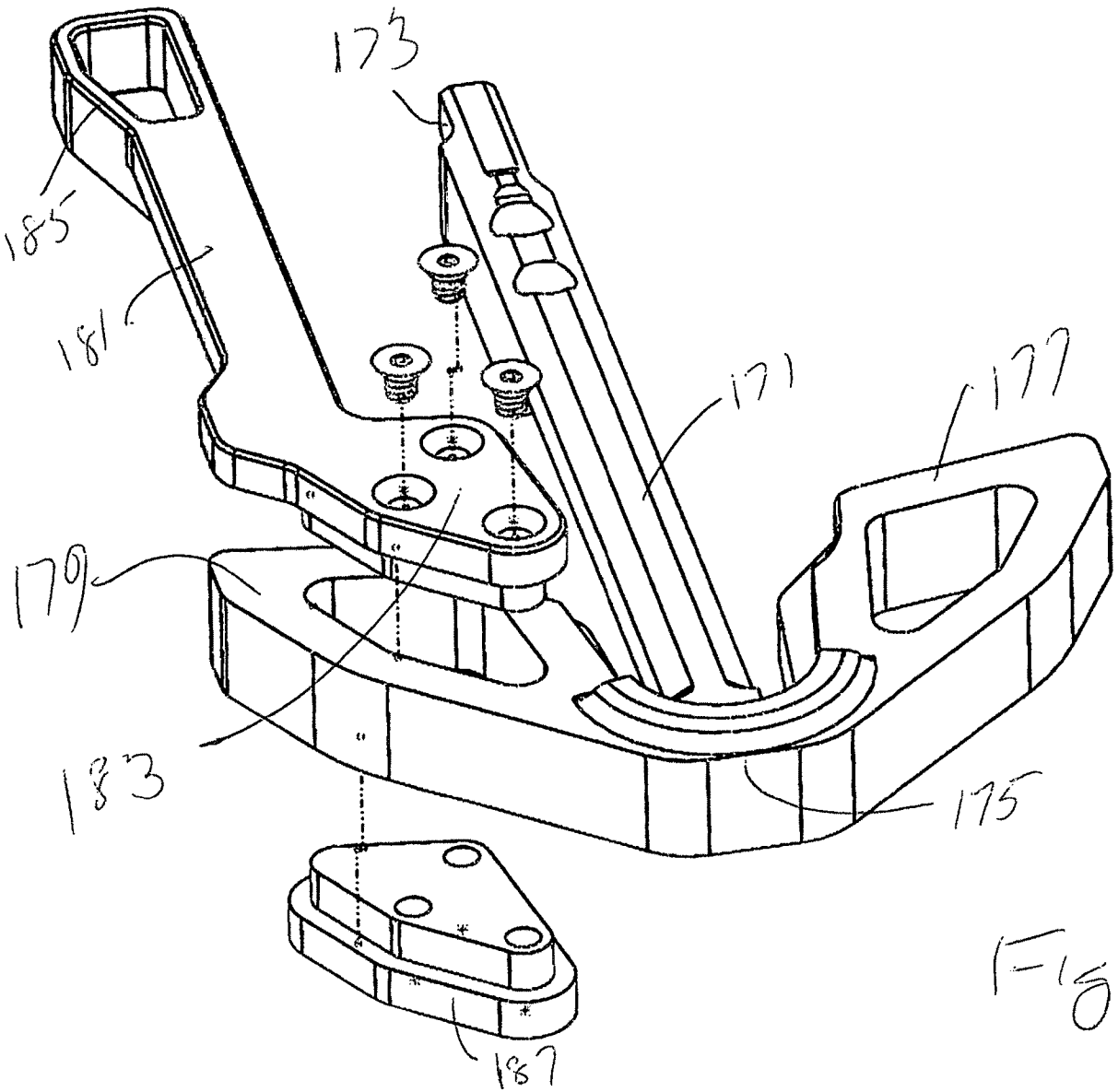

FIGS. 10 and 11 show oblique views of other embodiments of present invention devices wherein each has a combination pull handle/charge handle and metal gas diverting block mechanism, and wherein FIG. 10 shows a single pull handle on the right side (it is possible to mount a single pull handle in any combination of left/right side) and FIG. 11 shows a double pull handle, one on the left side and one on the right side, to accommodate both left and right-handed users;

FIG. 12 illustrates a top view of a prior art conventional semi-automatic AR-style rifle pull/charge handle with an attachment component at the pull handle (spring actuated charge handle locking/release mechanism) that is eliminated in the present invention combination pull handle and metal gas diverting block mechanism;

FIG. 13 illustrates an oblique view of a present invention combination pull/charge handle and gas diverting metal block mechanism shown in FIG. 11, but here attached to a carrier assembly;

FIGS. 14*a* and 14*b* illustrate a top view and an oblique view of a different present invention combination pull/charge handle and gas diverting metal block mechanism with a gas diversion channel and one normal and one elongated (extended) pull handle;

FIGS. 15*a*, 15*b* and 15*c* illustrate a top view, a bottom view and an exploded oblique view of a different present invention combination pull/charge handle and gas diverting metal block mechanism wherein the charge handle and block are unistructural and the pull handles are a single separate component connected thereto;

FIG. 16 illustrates an exploded oblique view of the present invention combination pull handle/metal gas diverting block mechanism shown in FIGS. 15*a*, 15*b* and 15*c* being attached to a carrier assembly; and, FIGS. 17*a* and 17*b* show oblique view and an exploded oblique view the present invention combination pull handle/metal gas diverting block mechanism shown in FIGS. 15*a*, 15*b* and 15*c* with a reversible pull arm extending the pull handle.

Figure 18:
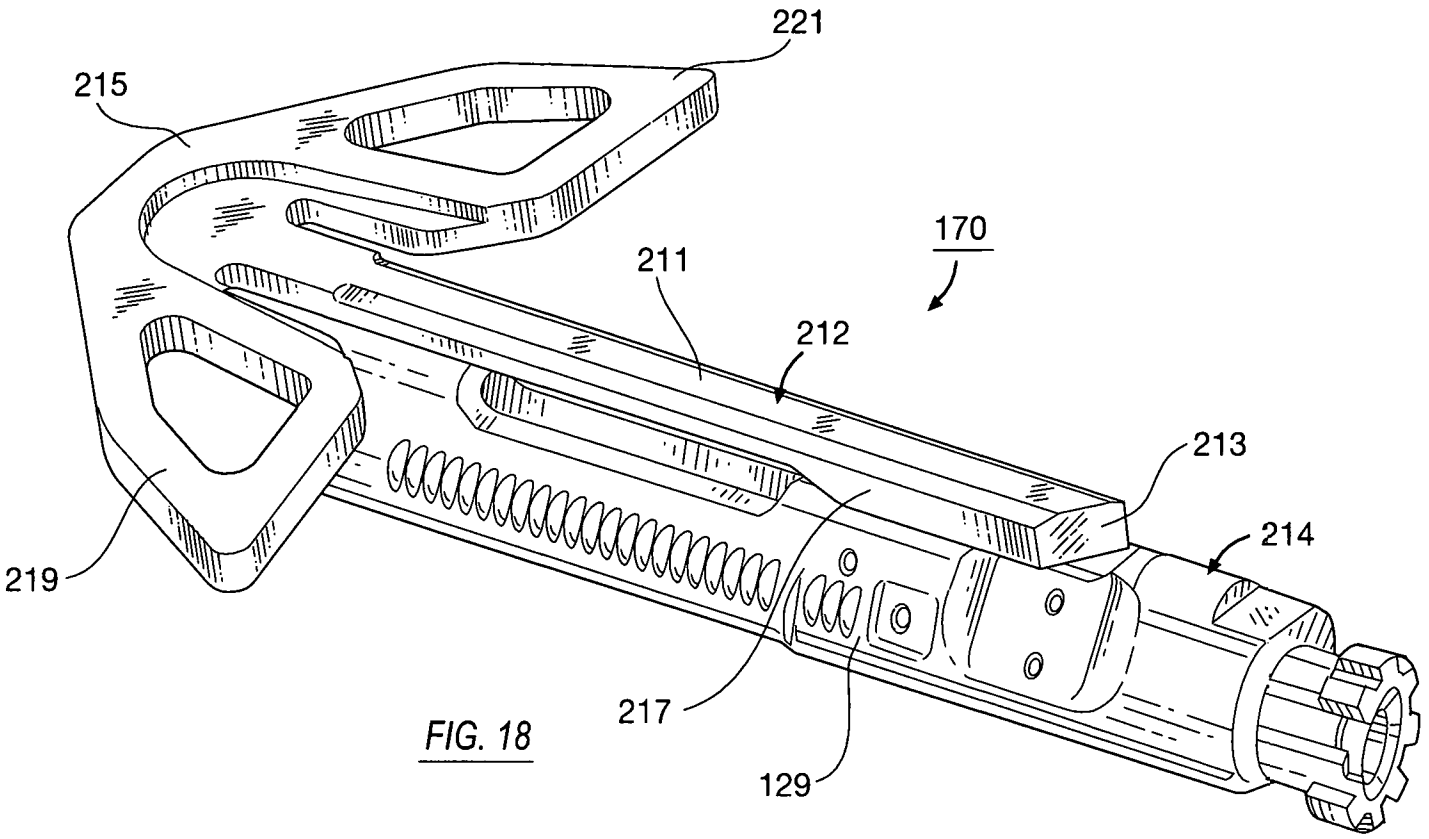

FIG. 18 is directed to an embodiment wherein the metal gas diverting block mechanism has a front end that includes a deflection wall angled askew from the right angle to the bolt carrier.

Figure 19:
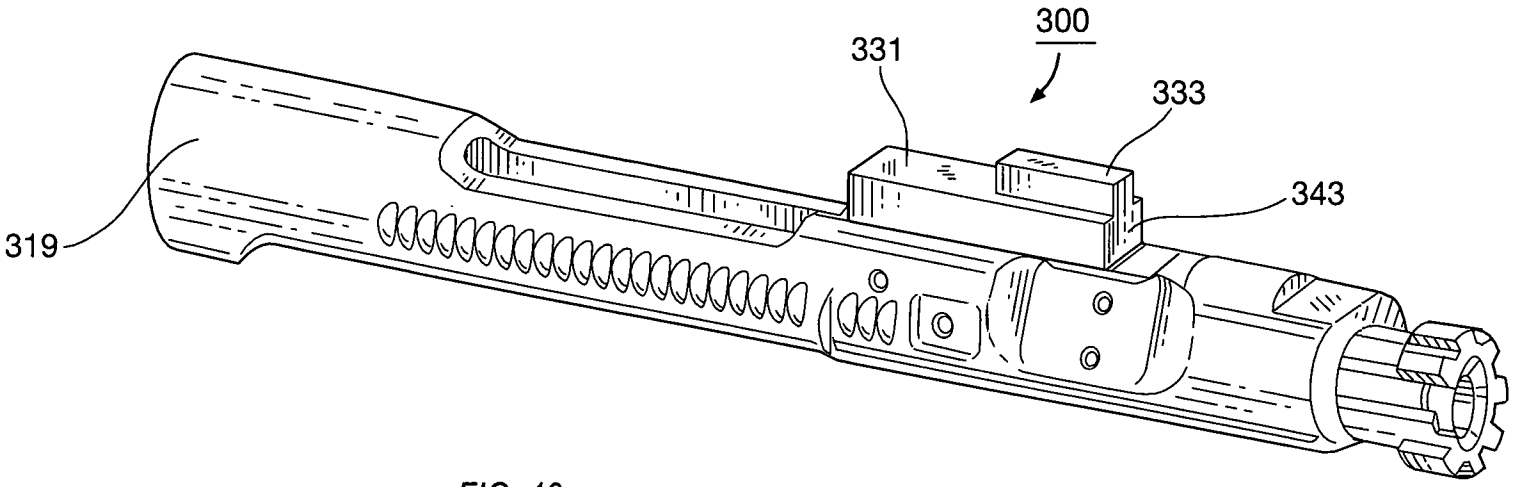
Figure 20:
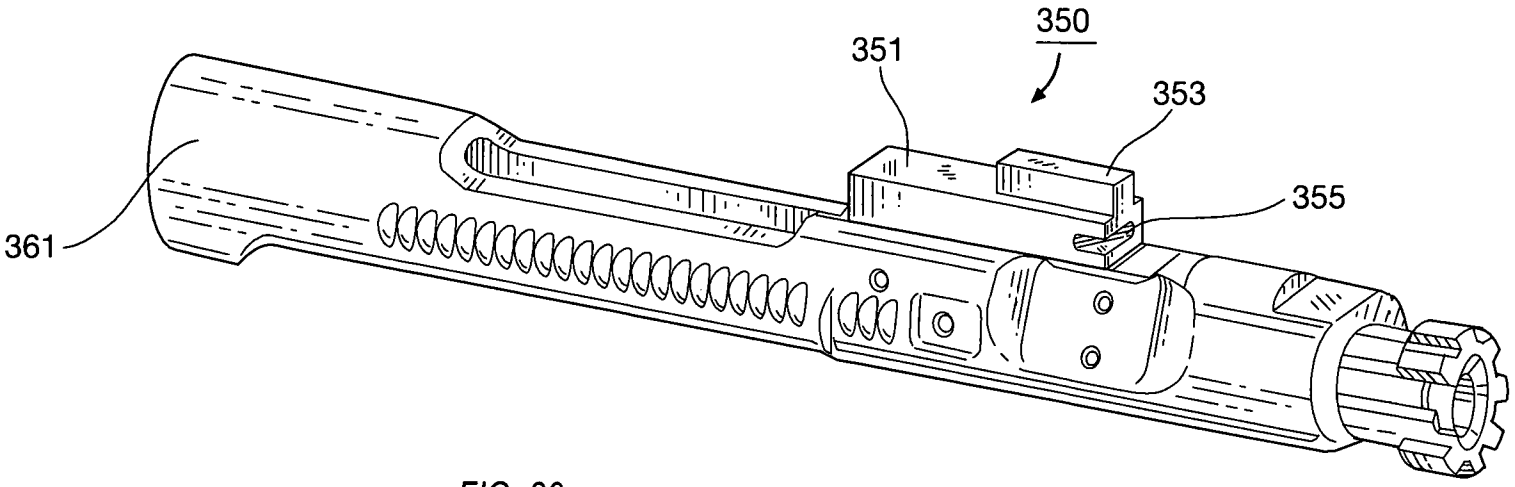

FIG. 19 is directed to an embodiment wherein the metal gas diverting block mechanism has a front end that includes a deflection wall angled at a right angle to the bolt carrier; and FIG. 20 is directed to an embodiment wherein the metal gas diverting block mechanism has a front end that includes a deflection wall with a diversion channel.

DETAILED DESCRIPTION OF THE EMBODIMENTS

AR style rifles are manufactured as semi-automatic weapons that may be repeatedly fired in rapid sequence by repeated rapid pulling of the trigger, that is, a single spent case is automatically ejected, and the next round is automatically moved into the firing position with every single pull of the trigger. This is accomplished by propellant gas direct impingement. Direct Impingement is the original technology, devised by Eugene Stoner. At the pull of the trigger and the firing of a single round of ammunition, propellant gas is bled through a small hole located in the barrel, which is then channeled through a very small tube back in the direction of the chamber where it can proceed to directly contact (or impinge) the bolt carrier mechanism through a carrier gas key. At this point the bolt carrier group is pushed to the rear of the rifle, extracting and ejecting the spent casing, and resetting the hammer. The bolt carrier group is then pushed forward by spring-loaded action, stripping an unspent cartridge from the magazine, loading it directly into the chamber of the barrel, readying the rifle to fire another single round at another pull of the trigger. To qualify as a semiautomatic AR style rifle, such as an AR-15, a rifle must be self-loading, and be able to perform a specific set of basic functions mechanically, without user assistance. To be more specific, when depressing the trigger, the rifle needs to fire a single cartridge, and then extract that spent casing from the chamber and eject it in some manner from the rifle, and then automatically reset the hammer. Next, it must then load an unspent cartridge into the chamber. The round is advanced from the magazine, chambered, the breech is then locked, and the rifle is ready to fire another single round. The rifle will then have a fresh round loaded, and again be ready to fire by simply pulling the trigger again. The present invention is directed to eliminating the foregoing semi-automatic features to render the rifle no longer semi-automatic, but instead, make it a single shot, straight pull bolt action; requiring user actions to accomplish eject/reload functions. Thus, what the present invention does is a) prevent the AR rifle from functioning as a semi-automatic rifle; and, b) it changes the most basic functionality of the rifle. What we are left with when using this invention is something that aesthetically looks like an AR style rifle (e.g. AR-15) but no longer acts, behaves, or performs as it was originally intended.

Many semi-automatic AR style rifles such as the AR-10, AR-15, M-16, M-4 and others have been modified to accommodate different size ammunition cartridges, to enhance functional speed, to accommodate left handed people, to convert to single shot and/or to change from pull action to side charging action. These conversion packages involve complex, expensive component change outs, and, very often, upper receiver modifications that require metal machining, cutting, drilling, welding or other complex changes, or the purchase of a totally new and sometimes proprietary (non-mil-spec) upper components. The present invention is directed to inexpensive, simple and convenient devices and methods for conversion of such semi-automatic rifles to single shot, straight pull bolt action rifles, without modifying any of the main carrier system or upper structures of the rifle and maintaining the factory integrity and mil-spec components of the rifle, with the sole exception of the elimination of the carrier gas key, or carrier gas key and bolt carrier, to replace these with a gas diverting block mechanism. In the present invention, the carrier gas key, or the carrier gas key, pull handle, and/or bolt carrier, are removed and the present invention device is installed. All of the complexities and physical structure modifications (drilling, cutting, machining, etc.) are completely eliminated, along with avoidance of needing to purchase separate, proprietary or non-military spec upper components.

Figure 1:
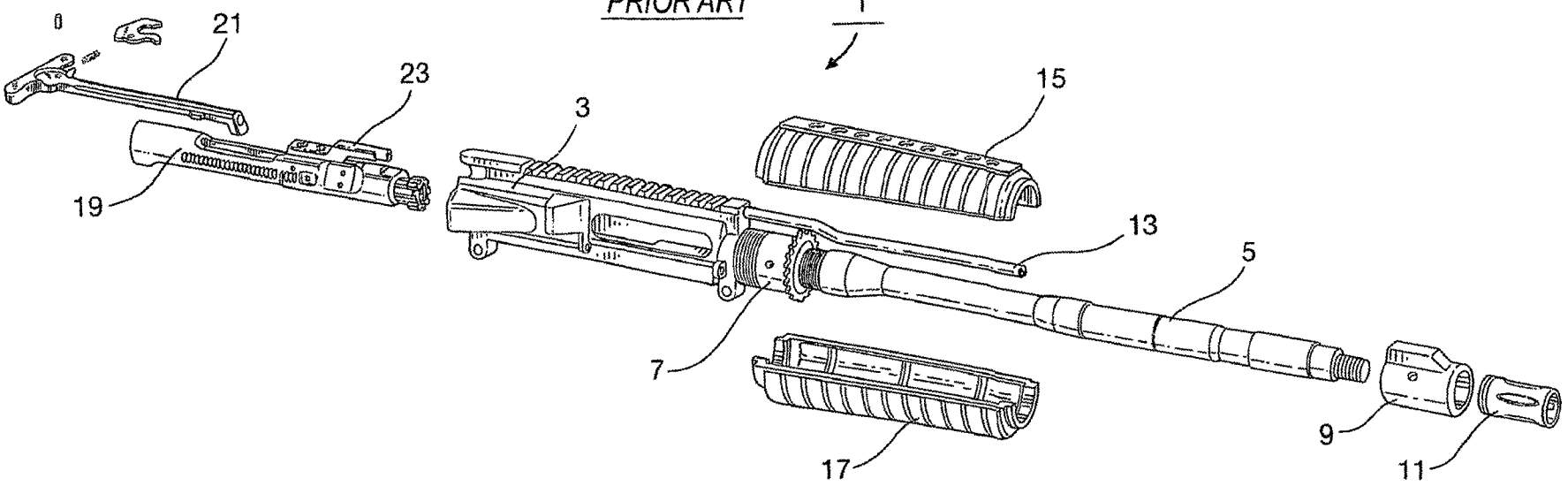
FIG. 1 PRIOR ART
FIG. 1 is an oblique view of parts of a prior art AR-15 rifle, illustrating, among other things, a conventional (factory production) bolt carrier assembly.

In FIG. 1, PRIOR ART, an oblique view of parts of a prior art AR-15 rifle, illustrates, among other things, a conventional (factory production) bolt carrier assembly. In general, one of ordinary skill in this art recognizes the detailed components of an AR-15, and thus not all details of the entire weapon are discussed here. For example, the bolt carrier group has elements that are not featured or described because they are not affected by the present invention, such as the bolt, firing pin, etc. Likewise, the trigger and lower assembly are removed from the Figure and are not relevant to the present invention. FIG. 1 shows a typical direct impingement semi-automatic AR style rifle (e.g. AR-15) upper receiver assembly parts in an exploded view. This Figure is used to show both the prior art structure and the functionality of direct impingement gas powered semi-automatic operation in an AR style rifle. Thus, in FIG. 1, the following parts, among others, are shown: upper receiver 3, barrel 5, connecting barrel nut 7, gas block 9, flash suppressor 11, gas tube 13, upper and lower hand guard portions 15 and 17, bolt carrier 19, charging handle with spring enabled locking mechanism 21 and carrier gas key 23. When a bullet is fired down the barrel, gas from the barrel 5 flows through the gas block 9 and gas tube 13 into the upper receiver 3. Gas is trapped in the barrel as the bullet moves toward and then past the gas block port. After the bullet passes the gas port, the gas behind the bullet flows into the gas block port and down the gas tube 13, located above the barrel 5, as shown. The gas tube protrudes into the carrier gas key 23 which accepts the gas and funnels it through the bolt carrier 19 via a gas key 23 and into the bolt. This initiates the automatic gas actuated cycling of the bolt carrier 19. The ammunition casing is automatically ejected and the next cartridge is automatically loaded for firing. By this gas push and spring return, the bolt carrier cycles backwards and forwards automatically between each shot. (The bolt located within the bolt carrier is propelled back by expanding gas and propelled forward by the recoil spring.) The barrel nut 7, as shown, connects the upper receiver 3 to the barrel 5 of the AR style rifle.

Figure 2:
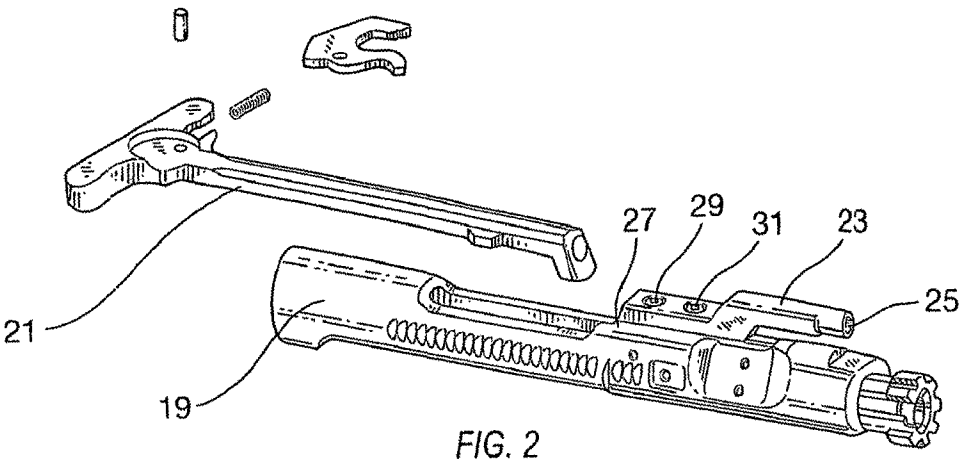
FIG. 2 PRIOR ART
FIG. 2 shows an oblique view of further details of a prior art conventional bolt carrier assembly, conventional carrier gas key, and conventional charge handle.

FIG. 2 shows an oblique view of further details of the PRIOR ART conventional carrier assembly with carrier gas key, thus being a larger drawing of a portion of that which is shown in FIG. 1 above, and, further, wherein identical parts in both drawings may be identically numbered and thus, not now repeated. Most importantly, there is a more detailed aspect of carrier gas key 23. As can be seen, the carrier gas key 23 is mounted on bolt carrier 19 with two recess-positioned screws 29 and 31, situated on rear portion 27 of carrier gas key 23. Forward on key 23 is the gas key gas port 25 that is necessary for the rifle to function in a semi-automatic mode, and which is replaced by the present invention and thus the gas impingement functionality is inhibited (the gas is physically blocked from entering the bolt carrier), rendering the rifle a single shot, straight pull bolt action rifle and no longer a semi-automatic rifle.

FIG. 3 is an oblique view of one present invention metal gas diverting block mechanism 30 that replaces the conventional carrier gas key (such as carrier gas key 23 of the preceding Figures) to block gas flow to and through the bolt carrier and bolt, and divert gas out of the rifle, and thus to prevent semi-automatic operation of the rifle and to thereby convert it to a single shot, straight pull bolt action. Present invention metal gas diverting block mechanism 30 is preferably made from a single block of metal (cast, machined or otherwise formed) and has a base 31, a raised metal gas diverting block component 33, and recesses 39 and 41, with screw-receiving orifices 35 and 37 for mounting in place of a conventional carrier gas key. Note that the block front end 43 has a deflection wall that is angled askew from a right angle to relative to said bolt carrier (by askew from a right angle is meant that at least a portion of the front end is not at right angle to the direction of movement of the carrier). While this front end in this figure is flat and of constant angle, without exceeding the scope of the present invention, this may alternatively be curved, pointed, grooved, channeled or otherwise, as long as a portion of the front end is not at a right angle to the elongation and travel direction of the carrier. This further improvement fully diverts gas and allows it to exit the rifle.

FIG. 4*a* shows a top view and FIG. 4*b* shows a side view of metal gas diverting block mechanism 30 of FIG. 3. Identical components are identically numbered.

FIG. 5 is an oblique view of another present invention metal gas diverting block mechanism 50 that replaces a conventional carrier gas key to block gas flow to and through the bolt carrier and bolt and to divert gas out of the rifle. This prevents semi-automatic operation of the rifle and thereby converts it to a single shot, straight pull bolt action rifle. Present invention metal gas diverting block mechanism 50 is preferably made from a single block of metal (cast, machined or otherwise formed) and has a base 51, a raised metal gas diverting block component 53, and recesses 59 and 61, with screw-receiving orifices 55 and 57 for mounting in place of a conventional carrier gas key. Without exceeding the scope of the present invention, the gas diverting block mechanism's front end can in some embodiments be angled askew from a right angle relative to the bolt carrier either facing the right side of the rifle so as to divert gas out of rifles built with conventional right handed upper receivers (i.e., the ejection port on the right hand side of the rifle), or askew facing the left side of the rifle so as to divert gas out of rifles built with conventional left handed upper receivers (i.e., the ejection port comes from the factory on the left hand side of the rifle). Here, the front end as a flat portion 63 and a partially askew portion 66.

FIG. 6*a* shows a top view and FIG. 6*b* shows a side view of metal gas diverting block mechanism 50 of FIG. 5. Identical components are identically numbered.

FIG. 7 is an oblique view of another present invention metal gas diverting block mechanism 70 that replaces a conventional carrier gas key to block gas flow to and through the bolt carrier and bolt and to divert gas out of the rifle. As with other embodiments of the present invention described above, this embodiment prevents semi-automatic operation of the rifle and thereby converts it to a single shot, straight pull bolt action rifle. Present invention metal gas diverting block mechanism 70 is preferably made from a single block of metal (cast, machined or otherwise formed) and has a base 71, a raised metal gas diverting block component 73, and recesses 79 and 61, with screw-receiving orifices 75 and 77 for mounting in place of a conventional carrier gas key. Note that the block front end is mostly at a right angle to the carrier, except that here there is an askew channel 83 formed to divert gas away from the interior of the rifle (directed to expel gas out of the rifle's casing ejection port). Without exceeding the scope of the present invention, the askew channel can in some embodiments be angled askew from a right angle relative to the bolt carrier either facing the right side of the rifle so as to divert gas out of rifles built with conventional right handed upper receivers (i.e., the ejection port comes from the factory on the right hand side of the rifle), or askew facing the left side of the rifle so as to divert gas out of rifles built with conventional left handed upper receivers (i.e., the ejection port comes from the factory on the left hand side of the rifle).

FIG. 8*a* shows a top view and FIG. 8*b* shows a side view of metal gas diverting block mechanism 70 of FIG. 7 to further illustrate this embodiment. Identical components are identically numbered. These grooves could take any exit path and remain within the scope of the present invention.

FIG. 9 illustrates an oblique side view of a present invention metal gas diverting block mechanism 30 from above (FIGS. 3, 4*a* and 4*b*, with identical parts identically numbered), attached to a carrier 19. This metal gas diverting block mechanism 30 is attached to carrier 19 by the two screws normally used to attach a carrier gas key, at recesses 39 and 41. This blocks gas flow to the carrier assembly and prevents semi-automatic shooting by neutralizing the direct impingement gas operation, as described above, and it diverts gas away from the rifle (directed to expel gas out of the rifle's casing ejection port). This limits the amount of block gas's flowing around the bolt carrier group and throughout the interior of the upper receiver of the rifle which could cause sticking or jamming of the bolt carrier group as a result of excessive carbon build-up/fouling.

FIGS. 10 and 11 show oblique views of other embodiments of present invention devices wherein each has a combination pull handle/charge handle and metal gas diverting block mechanism, and wherein FIG. 10 shows a single pull handle on the right side (it is possible to mount a pull handle in any combination of left/right side to accommodate left/right hand use), and FIG. 11 shows a double pull handle, one on the left side and one on the right side, to accommodate both left and right-handed users.

Referring specifically to FIG. 10, device 90 includes a main charge handle shaft 91 and, at its forward end, has a gas diverting block mechanism 95 with a gas-deflecting askew front 93, and attachment orifices 97 and 99. At its opposite end, has a pull handle 101. Pull handle 101 is set up for right hand use. If the handle 101 is established on the opposite side, it would be for left handed use. Recesses 67 and 69 contain attachment orifices for attaching to the screw holes originally made for attachment of a carrier gas key.

In FIG. 11, a present invention combination pull handle and metal gas diverting block mechanism device 110 is illustrated. Device 110 includes a main shaft 123 and, at its forward end, has a gas blocking mechanism 115, with a gas-deflecting partially askew front 111, flat portion 113, and attachment orifices 117 and 119. At its back end, there are opposing pull handles 121 and 125, with finger loops, as shown. This dual pull handle is set up for either right hand or left hand use, and handle shape and size can be modified according to user needs (hand size, shooting style, and ergonomics). The attachment orifices are for attaching the device to the screw holes originally made in a rifle's bolt carrier for the attachment of a carrier gas key.

FIG. 12 illustrates a top view of a prior art conventional semi-automatic AR-style rifle pull/charge handle, device 198, with an attachment component at the pull handle (spring actuated locking/release mechanism) 199 that is eliminated in the present invention combination pull handle and metal gas diverting block mechanism embodiments.

FIG. 13 illustrates an oblique view of a present invention combination pull/charge handle and gas diverting metal block mechanism device 110 shown in FIG. 11, but here attached to a carrier assembly 129. Identical parts here as shown in FIG. 11 are identically numbered.

FIGS. 14*a* and 14*b* illustrate a top view and an oblique view of a different present invention combination device 140 with a charge handle 141 and gas diverting metal block 143 built into it. Block 143 has a gas diversion channel 153, and attachment orifices 145 and 147. Additionally, unistructurally formed as a part of this one component are two pull handles, one is normal pull handle 151 and the other one is elongated (extended) pull handle 149.

FIGS. 15*a*, 15*b* and 15*c* illustrate a top view, a bottom view and an exploded oblique view of a different present invention combination pull/charge handle and gas diverting metal block device 170. Here the charge handle 171 and the gas blocking device 173 are unistructural (one-piece component), and block 173 includes an oblique (askew angle) diversion front surface 185, a channel, and two attachment orifices (unnumbered). The pull handles 177 and 179 are a single separate component and include a charge handle attachment yoke 175 with threaded orifices for connecting charge handle 171 to thereto with connecting (and preferably locking) screws 181 and 183.

FIG. 16 illustrates an exploded oblique view of the present invention combination pull handle/metal gas diverting block device 170 shown in FIGS. 15*a*, 15*b* and 15*c*, but here being attached to a carrier assembly 180 of rifle upper receiver 190.

FIGS. 17*a* and 17*b* show oblique view and an exploded oblique view of the present invention combination pull handle/metal gas diverting block device 170 shown in FIGS. 15*a*, 15*b* and 15*c*, but now with a reversible pull arm 181 extending the pull handle. Reversible pull arm 181 has an attachment end 183 that structurally corresponds to and fits into the finger loop of both pull handles 177 and 179. There is an attachment chock 187 that likewise corresponds to the end 183 and to the finger loops. This chock is attached on the underside and screwed together with the attachment end 183 of reversible pull arm 181 (which also has its own extended finger loop end 185). These can be flipped (reversed) and attached to the opposite side so as to accommodate either left or right handed users.

FIGS. 18, 19 and 20 are directed to the present invention embodiments recited above, to be used on conventional AR style rifles that include conventional AR style rifle components, including but not limited to an upper receiver and lower, trigger, trigger guard, barrel, and, a semi-automatic firing mechanism including a direct impingement gas actuated casing ejection, gas actuated bolt and hammer reset mechanism, and gas actuated cartridge reloading (a semi-automatic AR style rifle), and including the present invention embodiment with a bolt carrier assembly component that is unistructurally formed and comprised of a bolt carrier structure and an integrated metal gas diverting block mechanism. FIG. 18 is directed to an embodiment wherein the metal gas diverting block mechanism has a front end that includes a deflection wall angled askew from the right angle to the bolt carrier; FIG. 19 is directed to an embodiment wherein the metal gas diverting block mechanism has a front end that includes a deflection wall angled at a right angle to the bolt carrier; and FIG. 20 is directed to an embodiment wherein the metal gas diverting block mechanism has a front end that includes a deflection wall with a diversion channel. In all of these Figures, the metal gas diverting block mechanism being positioned so as to inhibit semi-automatic operation of the semi-automatic AR style rifle by blocking gas from entering the bolt carrier assembly towards the bolt and thereby disabling the automatic gas actuated casing ejection, automatic gas actuated bolt and hammer reset, and automatic gas actuated cartridge reload functionality, thereby rendering the AR style rifle a single shot, straight pull bolt action rifle.

Thus, in FIG. 18, there is presented an oblique view of a present invention embodiment of a semi-automatic rifle conversion element that is a single structure combination device 210, with a combination pull handle and metal gas diverting block mechanism device 212 and bolt carrier assembly structure 214, all formed in a single unistructural unit. These present invention devices may be formed by any known technique, such as casting, machining, 3-D printing and combinations thereof. Device 212 includes a main shaft 211 and, at its forward end, has a gas block mechanism 217, with a tapered gas-diverting surface 213 askew from a right angle to the bolt carrier assembly. At its back end 215, there are opposing pull handles 219 and 221, with finger loops, as shown. This dual pull handle is set up for either right hand or left hand use, and handle shape and size can be modified according to user needs (hand size, shooting style, and ergonomics). This combination readily replaces the conventional bolt carrier assembly with carrier gas key combination to convert a direct gas impingement AR-style semi-automatic rifle into a single shot, straight pull bolt action rifle.

In FIG. 19, there is presented an oblique view of a present invention embodiment of an AR Style gas direct impingement semi-automatic rifle conversion element that is a single structure combination device 300, with a combination metal gas diverting block mechanism device 331 and bolt carrier assembly structure 319, all formed in a single unistructural unit. Metal gas diverting block mechanism device 331 has a front end 333 that includes a flat surface wall 343 at a right angle to the bolt carrier assembly (perpendicular to direction of movement). This flat surface wall 343 blocks and diverts gas that would otherwise be channeled into a conventional bolt carrier group assembly by a carrier gas key in order to initiate direct impingement semi-automatic functionality; thereby blocking any gas actuated direct-impingement semi-automatic functionality and converting a semi-automatic AR style rifle into a single shot, straight pull bolt action rifle.

In FIG. 20, there is presented an oblique view of a present invention embodiment of a direct gas impingement semi-automatic AR style rifle conversion element that is a single structure combination device 350, with a combination metal gas diverting block mechanism device 351 and bolt carrier assembly structure 361, all formed in a single unistructural unit. Metal gas diverting block mechanism device 351 has a front end 353 that includes a gas diversion channel 355. This blocks and diverts gas that would otherwise be channeled into a conventional bolt carrier group assembly by a carrier gas key in order to initiate direct impingement semi-automatic functionality; thereby blocking any gas actuated direct-impingement semi-automatic functionality and converting a direct impingement semi-automatic AR style rifle into a single shot, straight pull bolt action rifle.

In addition to other advantageous features described above, the present invention combination charging handle with metal gas diverting block mechanism is, as mentioned, bolted directly to the bolt carrier in place of the carrier gas key, and also eliminates the need for, the complexity of, and the possible problems with, the conventional charging handle spring-loaded locking mechanism. Thus, these versions of the present invention has five simultaneous and synergistic advantages: (1) the direct impingement semi-automatic AR style rifle is converted to a single shot, straight pull bolt action rifle; (2) the conversion is accomplished without rebuilding the carrier or other mechanisms within the rifle; (3) no additional proprietary or non mil-spec upper receiver needs to be purchased; (4) no new machining or drilling or welding is needed for attachment; (5) the pull handle is locked in place on the upper without needing a spring actuated locking mechanism; and (6) as a result of eliminating the handle spring/lock, subsequent spring/lock wear and/or malfunction is eliminated.

As mentioned, as with all charge handle/gas diverting block combination versions of the present invention, there is no need for a spring locking mechanism on the charge handle (or any locking mechanism on the charge handle for that matter). This is important because current prior art versions with an extended design are more expensive and they require much more complex charge handled unlocking mechanisms which need to be actuated from the very end of the long arm.

In this present invention iteration with pull handles, the present invention devices allow for the shooter to pull from a more forward location on the rifle (further up towards the barrel), thereby providing the user with a more comfortable, natural, ergonomic pulling motion than is allowed by models where the pull motion is much closer to the face. The purpose behind this concept is to allow for the rifle to be charged manually without removing one's face from the shooting position (eyes aligned with the sights). This means that 99.9% of the time the rifle is manually charged with one hand and the other supports the rifle in a fixed position, i.e., only one hand instead of both hands needs to move to effect charging. To grab both sides of the pull handle at once would require the shooter to totally remove his face from the shooting position in order to make room for his forearm). The extended forward position allows for a more comfortable pulling motion as the hand and elbow are not as crowded by one's body and face. Most right handed shooters will pull with their left hands in order to maintain their shooting hand grip on the weapon and trigger guard. Still, the shorter pull handle on the right side allows for purchase if the shooter desires to pull with his right hand instead. Most shooters will pull only from one side, with one hand, because the goal is to stay in an accurate shooting position on the rifle during charging. Thus, another alternative embodiment would be a mirror image of the some of the above embodiments. Finally, the reversible extension arm variation will allow lefties and righties to try either side for pulling with or without the arm, to customize the present invention to suit each user's personal preference.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims. For example, the actual shape of the main housing may be any of numerous possibilities as long as its functionality as described is not affected adversely.

What is claimed is:

1. A production AR style direct gas impingement semi-automatic rifle that has been fixedly converted to a single shot, straight pull bolt action rifle, which includes: a) conventional rifle components comprising an upper receiver, and a lower receiver, a trigger, a trigger guard, and a barrel; b) a direct gas impingement semi-automatic firing mechanism including an automatic gas actuated casing ejection, automatic gas actuated bolt and hammer reset, and automatic gas actuated cartridge reload functionality and including a bolt carrier with two threaded carrier gas key receiving orifices and having no production carrier gas key and a having a fixed dual-bored metal gas diverting block mechanism attached to said bolt carrier at said two threaded carrier key receiving orifices, said dual-bored metal gas diverting block mechanism having a front end that is at least partially askew from a right angle to said bolt carrier, said front end being selected from the group consisting of: (i) a front end having a front wall with a deflection wall angled askew from said right angle to said bolt carrier; and (ii) a front end having a deflection channel angled askew from said right angle to said bolt carrier; said dual-bored metal gas diverting block mechanism being positioned so as to inhibit semi-automatic operation of said semi-automatic AR style rifle by disabling the automatic gas actuated casing ejection, the automatic gas actuated bolt and hammer reset, and the automatic gas actuated cartridge reload functionality, and rendering it a single shot, straight pull bolt action rifle.

2. A production AR-style direct gas impingement semi-automatic rifle that has been converted to a single shot, straight pull bolt action rifle of claim 1 wherein said metal gas diverting block mechanism is a metal selected from the group consisting of an aluminum, titanium, steel and stainless steel.

3. A production AR-style direct gas impingement semi-automatic rifle that has been converted to a single shot, straight pull bolt action rifle of claim 1 wherein said bolt carrier has a top flat portion with two threaded orifices for receiving carrier gas key screws and said metal gas diverting block mechanism contains two corresponding orifices and said metal block restrictor mechanism is screwed to said bolt carrier.

4. A production AR-style direct gas impingement semi-automatic rifle that has been converted to a single shot, straight pull bolt action rifle of claim 1 wherein said metal gas diverting block mechanism is a unitary component.

5. A production AR-style direct gas impingement semi-automatic rifle that has been converted to a single shot, straight pull bolt action rifle of claim 1 wherein there is further included a modified charge handle having an extension with two attachment orifices corresponding to said metal gas diverting block mechanism orifices and is correspondingly attached to said bolt carrier, wherein said metal gas diverting block mechanism and said charge handle, in combination, are selected from the group consisting of a single piece combination and a multiple piece combination.

6. A production AR-style direct gas impingement semi-automatic rifle that has been converted to a single shot, straight pull bolt action rifle of claim 5 wherein said metal gas diverting block mechanism and charge handle combination is selected from the group consisting of an aluminum, titanium, steel and stainless steel.

7. A production AR-style direct gas impingement semi-automatic rifle that has been converted to a single shot, straight pull bolt action rifle of claim 1 wherein said charge handle further includes at least one backward extending pull handle.

8. A production AR-style direct gas impingement semi-automatic rifle that has been converted to a single shot, straight pull bolt action rifle of claim 7 wherein said charge handle further includes two opposing backward extending pull handles.

9. A production AR-style direct gas impingement semi-automatic rifle that has been converted to a single shot, straight pull bolt action rifle of claim 8 wherein said charge handle and said two opposing backward extending pull handles are separate components that are connected to one another.

10. A production AR-style direct gas impingement semi-automatic rifle that has been converted to a single shot, straight pull bolt action rifle of claim 8 wherein said two opposing backward extending pull handles are left hand and right hand pull handles respectively, and one of said left hand and right pull handles further includes a pull handle extension removably attached to it, and further wherein said pull handle extension is interchangeable with the other of one of said left hand and right hand pull handles such that it is attachable to either of said left hand and right hand pull handles.

* * * * *